US010337848B2

(12) United States Patent
Rastegar

(10) Patent No.: US 10,337,848 B2
(45) Date of Patent: Jul. 2, 2019

(54) SPIN ACCELERATION ARMED INERTIA IGNITERS AND ELECTRICAL SWITCHES FOR MUNITIONS AND THE LIKE

(71) Applicant: Jahangir S Rastegar, Stony Brook, NY (US)

(72) Inventor: Jahangir S Rastegar, Stony Brook, NY (US)

(73) Assignee: OMNITEK PARTNERS LLC, Ronkonkoma, NY (US)

( * ) Notice: Subject to any disclaimer, the term of this patent is extended or adjusted under 35 U.S.C. 154(b) by 0 days.

(21) Appl. No.: 15/844,614

(22) Filed: Dec. 17, 2017

(65) Prior Publication Data

US 2018/0180393 A1 Jun. 28, 2018

Related U.S. Application Data

(60) Provisional application No. 62/438,983, filed on Dec. 23, 2016.

(51) Int. Cl.
*F24C 15/24* (2006.01)
*F42C 15/22* (2006.01)
(Continued)

(52) U.S. Cl.
CPC ..... *F42C 15/24* (2013.01); *F42C 15/22* (2013.01); *F42C 1/04* (2013.01); *F42C 7/12* (2013.01)

(58) Field of Classification Search
CPC ..... F42C 15/24; F42C 15/26; F42C 15/22
See application file for complete search history.

(56) References Cited

U.S. PATENT DOCUMENTS 1,956,223 A * 4/1934 Methlin ..... F42C 1/02 102/243
2,458,474 A * 1/1949 Jordan ..... F42C 15/26 102/262

(Continued)

FOREIGN PATENT DOCUMENTS

FR 366810 A * 10/1906 ..... F42C 15/20
FR 731949 A * 9/1932 ..... F24C 15/26
GB 130659 A * 8/1919 ..... F24C 15/26

OTHER PUBLICATIONS

Machine Translation of FR 366,810 (Year: 1906).*

*Primary Examiner* — Joshua T Semick

(57) ABSTRACT

An apparatus actuatable under a rotary acceleration having a predetermined duration and magnitude. The apparatus including: a body having a first channel and a second channel, the second channel being disposed radially offset from the first channel; a mass disposed in the first channel, the mass having an arm disposed at a first end of the mass and the arm being rotatable from a first position in which the arm cannot move within the second channel to a second position in which the arm can move inside the second channel; a first biasing spring member having a first end connected to the body and a second end connected to the arm such that when the arm is subjected to the rotary acceleration greater than the predetermined duration and magnitude, the arm is biased to rotate from the first position to the second position; wherein the mass is connected to the arm such that the mass moves in the first channel and the arm moves in the second channel when the arm is biased into the second position.

9 Claims, 13 Drawing Sheets

(51) Int. Cl.

| | |
|---|---|
| ***F42C 15/24*** | (2006.01) |
| *F42C 7/12* | (2006.01) |
| *F42C 1/04* | (2006.01) |

(56) References Cited

U.S. PATENT DOCUMENTS 4,738,201 A * 4/1988 Holt ..... F42C 19/06
102/221
8,869,700 B2 * 10/2014 Rastegar ..... F42C 11/008
102/216

* cited by examiner

SPIN ACCELERATION ARMED INERTIA IGNITERS AND ELECTRICAL SWITCHES FOR MUNITIONS AND THE LIKE

CROSS-REFERENCE TO RELATED APPLICATION

This application claims benefit to U.S. Provisional Patent Application No. 62/438,983 filed on Dec. 23, 2016, the entire contents of which is incorporated herein by reference.

BACKGROUND

1. Field

The present invention relates generally to simultaneous linear and rotary acceleration (deceleration) operated mechanical mechanisms, and more particularly for inertial igniters for reserve batteries used in gun-fired munitions and other similar applications or electrical switches to open (close) a normally closed (open) circuit upon the device experiencing a prescribed simultaneous linear and rotary acceleration profile threshold.

2. Prior Art

Reserve batteries of the electrochemical type are well known in the art for a variety of uses where storage time before use can be extremely long and on the order of several decades. Reserve batteries are in use in applications such as batteries for gun-fired munitions including guided and smart, mortars, fusing mines, missiles, and many other military and commercial applications. The electrochemical reserve-type batteries can in general be divided into two different basic types.

The first type includes the so-called thermal batteries, which are to operate at high temperatures. Unlike liquid reserve batteries, in thermal batteries the electrolyte is already in the cells and therefore does not require a release and distribution mechanism such as spinning. The electrolyte is dry, solid and non-conductive, thereby leaving the battery in a non-operational and inert condition. These batteries incorporate pyrotechnic heat sources to melt the electrolyte just prior to use in order to make them electrically conductive and thereby making the battery active. The most common internal pyrotechnic is a blend of Fe and $KClO_4$. Thermal batteries utilize a molten salt to serve as the electrolyte upon activation. The electrolytes are usually mixtures of alkali-halide salts and are used with the Li(Si)/$FeS_2$ or Li(Si)/$CoS_2$ couples. Some batteries also employ anodes of Li(Al) in place of the Li(Si) anodes. Insulation and internal heat sinks are used to maintain the electrolyte in its molten and conductive condition during the time of use.

Thermal batteries have long been used in munitions and other similar applications to provide a relatively large amount of power during a relatively short period of time, mainly during the munitions flight. Thermal batteries have high power density and can provide a large amount of power as long as the electrolyte of the thermal battery stays liquid, thereby conductive. The process of manufacturing thermal batteries is highly labor intensive and requires relatively expensive facilities. Fabrication usually involves costly batch processes, including pressing electrodes and electrolytes into rigid wafers, and assembling batteries by hand. The batteries are encased in a hermetically-sealed metal container that is usually cylindrical in shape.

The second type includes the so-called liquid reserve batteries in which the electrodes are fully assembled for cooperation, but the liquid electrolyte is held in reserve in a separate container until the batteries are desired to be activated. In these types of batteries, by keeping the electrolyte separated from the battery cell, the shelf life of the batteries is essentially unlimited. The battery is activated by transferring the electrolyte from its container to the battery electrode compartment.

A typical liquid reserve battery is kept inert during storage by keeping the aqueous electrolyte separate in a glass or metal ampoule or in a separate compartment inside the battery case. The electrolyte compartment may also be separated from the electrode compartment by a membrane or the like. Prior to use, the battery is activated by breaking the ampoule or puncturing the membrane allowing the electrolyte to flood the electrodes. The breaking of the ampoule or the puncturing of the membrane is achieved either mechanically using certain mechanisms usually activated by the firing setback acceleration or by the initiation of certain pyrotechnic material. In these batteries, the projectile spin or a wicking action is generally used to transport the electrolyte into the battery cells.

Reserve batteries are inactive and inert when manufactured and become active and begin to produce power only when they are activated. Reserve batteries have the advantage of very long shelf life of up to 20 years that is required for munitions applications.

Thermal batteries generally use some type of initiation device (igniter) to provide a controlled pyrotechnic reaction to produce output gas, flame or hot particles to ignite the heating elements (pyrotechnic materials) of the thermal battery. There are currently two distinct classes of igniters that are available for use in thermal batteries. The first class of igniter operates based on electrical energy. Such electrical igniters, however, require electrical energy, thereby requiring an onboard battery or other power sources with related shelf life and/or complexity and volume requirements to operate and initiate the thermal battery. The second class of igniters, commonly called "inertial igniters", operates based on the firing acceleration. The inertial igniters do not require onboard batteries for their operation and are thereby often used in munitions applications such as in gun-fired munitions and mortars.

Inertial igniters are also used to activate liquid reserve batteries through the rupture of the electrolyte storage container or membrane separating it from the battery core. The inertial igniter mechanisms may also be used to directly rupture the electrolyte storage container or membrane.

Inertial igniters used in munitions must be capable of activating only when subjected to the prescribed setback acceleration levels and not when subjected to all so-called no-fire conditions such as accidental drops or transportation vibration or the like. This means that safety in terms of prevention of accidental ignition is one of the main concerns in inertial igniters.

Inertia-based igniters must provide two basic functions. The first function is to provide the capability to differentiate the aforementioned accidental events such as drops over hard surfaces or transportation vibration or the like, i.e., all no-fire events, from the prescribed firing setback acceleration (all-fire) event. In inertial igniters, this function is performed by keeping the device striker fixed to the device structure during all aforementioned no-fire events until the prescribed firing setback acceleration event is detected. At which time, the device striker is released. The second function of an inertia-based igniter is to provide the means of accelerating the device striker to the kinetic energy that is needed to initiate the device pyrotechnic material as it (hammer element) strikes an inertial igniter body provided "anvil" over which the pyrotechnic material is provided. In general, the striker is provided with a relatively sharp point which strikes the pyrotechnic material covering a raised surface over the anvil, thereby allowing a relatively thin pyrotechnic layer to be pinched to achieve a reliable ignition mechanism. Alternatively, the anvil with the covered pyrotechnic material may be provided on the striker element and the sharp point on the device base structure.

In many applications, percussion primers are directly mounted on the anvil (striker) side of the device and the required initiation pin is machined or attached to the striker (anvil) to impact and initiate the primer.

In either design, exit holes are provided on the inertial igniter to allow the reserve battery activating flames and sparks to exit.

Two basic methods are currently available for accelerating the device striker to the aforementioned needed velocity (kinetic energy) level. The first method is based on allowing the setback acceleration to accelerate the striker mass following its release. This method requires the setback acceleration to have long enough duration to allow for the time that it takes for the striker mass to be released and for the striker mass to be accelerated to the required velocity before pyrotechnic impact. Thus, this method is applicable to larger caliber and mortar munitions and rockets in which the setback acceleration duration is relatively long and in the order of several milliseconds, sometimes even longer than 10-15 milliseconds. This method is also suitable for impact induced initiations in which the impact induced decelerations have relatively long duration.

The second method relies on potential energy stored in a spring (elastic) element, which is then released upon the detection of the prescribed all-fire conditions. This method is suitable for use in munitions that are subjected to very short setback accelerations, such as those of the order of 1-2 milliseconds. This method is also suitable for impact induced initiations in which the impact induced decelerations could have relatively short durations.

Inertia-based igniters must therefore comprise two components so that together they provide the aforementioned mechanical safety (the capability to differentiate the prescribed all-fire condition from all aforementioned no-fire conditions) and to provide the required striking action to achieve ignition of the pyrotechnic elements. The function of the safety system is to keep the striker element in a relatively fixed position in the direction of initiation strike until the prescribed all-fire condition (or the prescribed impact induced deceleration event) is detected, at which time the striker element is to be released, allowing it to accelerate toward its target under the influence of the remaining portion of the setback acceleration or by the force generated by the aforementioned potential energy stored in a spring (elastic) element. The ignition itself may take place as a result of striker impact, or simply contact or proximity. For example, the striker may be akin to a firing pin and the target akin to a standard percussion cap primer. Alternately, the striker-target pair may bring together one or more chemical compounds whose combination with or without impact will set off a reaction resulting in the desired ignition.

Currently available technology (see e.g., U.S. Pat. Nos. 7,437,995; 7,587,979; and 7,587,980; U.S. Application Publication No. 2009/0013891 and U.S. application Ser. Nos. 61/239,048; 12/079,164; 12/234,698; 12/623,442; 12/774,324; and 12/794,763 the entire contents of each of which are incorporated herein by reference) has provided solution to the requirement of differentiating accidental drops during assembly, transportation and the like (generally for drops from up to 7 feet over concrete floors that can result in impact deceleration levels of up to 2000 G over up to 0.5 milli-seconds). The available technology differentiates the above accidental and initiation (all-fire) events by both the resulting impact induced inertial igniter (essentially the inertial igniter structure) deceleration and its duration with the firing (setback) acceleration level that is experienced by the inertial igniter and its duration, thereby allowing initiation of the inertial igniter only when the initiation (all-fire) setback acceleration level as well as its designed duration (which in gun-fired munitions of interest such as artillery rounds or mortars or the like is significantly longer than drop impact duration) are reached. This mode of differentiating the "combined" effects of accidental drop induced deceleration and all-fire initiation acceleration levels as well as their time durations (both of which would similarly tend to affect the start of the process of initiation by releasing a striker mass that upon impact with certain pyrotechnic material(s) or the like would start the ignition process) is possible since the aforementioned up to 2000 G impact deceleration level is applied over only 0.5 milli-seconds (msec), while the (even lower level) firing (setback) acceleration (generally not much lower than 900 G) is applied over significantly longer durations (generally over at least 8-10 msec).

The need to differentiate accidental and initiation accelerations by the resulting shock loading level of the event necessitates the employment of a safety system which is capable of allowing initiation of the igniter only during high total impulse levels, i.e., when the prescribed all-fire acceleration level is detected over long enough duration to differentiate event from accidental events, which are either low in acceleration level such as vibration duration transportation or are short in duration such as accidental drop over a hard surface.

Inertial igniters that are used in munitions that are loaded into ships by cranes for transportation are highly desirable to satisfy another no-fire requirement arising from accidental dropping of the munitions from heights reached during ship loading. This requirement generally demands no-fire (no initiation) due to drops from up to 40 feet that can result in impact induced deceleration levels (of the inertial igniter structure) of up to 18,000 Gs acting over up to 1 msec time intervals. Currently, inertial igniters that can satisfy this no-fire requirement when the all-fire (setback) acceleration levels are relatively low (for example, as low as around 900 G and up to around 3000 Gs) are not available. In addition, the currently known methods of constructing inertial igniters for satisfying 7 feet drop safety (resulting in up to 2,000 Gs of impact induced deceleration levels for up to 0.5 msec impulse) requirement cannot be used to achieve safety (no-initiation) for very high impact induced decelerations resulting from high-height drops of up to 40 feet (up to 18,000 Gs of impact induced decelerations lasting up to 1 msec). This is the case for several reasons. Firstly, impacts following drops occur at significantly higher impact speeds for drops from higher heights. For example, considering free drops and for the sake of simplicity assuming no drag to be acting on the object, impact velocities for a drop from a height of 40 feet can reach approximately 15.4 m/sec as compared to a drop from a height of 7 feet is of approximately 6.4 m/sec, or about 2.3 times higher for 40 feet drops.

Secondly, the 7 foot drops over a concrete floor lasts only up to 0.5 seconds, whereas 40 feet drop induced inertial igniter deceleration levels of up to 18,000 Gs can have durations of up to 1 msec. As a result, as it is shown later in this disclosure the distance travelled by the inertial igniter striker mass releasing element is so much higher for the aforementioned 40 feet drops as compared to 7 foot drops that it has made the development of inertial igniters that are safe (no-initiation occurring) as a result of such 40 feet drops impractical.

Thus, it is shown that it is not possible to use the methods used in the design of currently available inertial igniters to provide no-fire safety for accidental drops from height of up to 7 feet (such as those described in the aforementioned patents and patent applications and the prior art indicated therein) to design inertial igniters that provide no-fire safety for the aforementioned drops from heights of up to 40 feet.

In the case of munitions that are fired by rifled gun barrels or are provided with other means of being spin accelerated during firing to certain barrel exit linear velocity as well as spin rate, or the so-called spin-stabilized munitions, the munitions is subjected simultaneously to both a linear set-back acceleration profile as well as a spin acceleration profile. However, when munitions are subjected to accidental drops, even from great heights, or nearby explosions or the like, it is impossible for them to be subjected simultaneously to both high firing setback induced linear as well as spin accelerations. In the present invention, this characteristic of spin stabilized munitions of various kinds is used to develop methods to design inertial igniters and to construct inertial igniters that require to detect the prescribed all-fire setback induced spin acceleration as well as linear accelerations for initiation.

A schematic of a cross-section of a conventional thermal battery and inertial igniter assembly is shown in FIG. 1. In thermal battery applications, the inertial igniter 10 (as assembled in a housing 18) is generally positioned above (in the direction of the acceleration) the thermal battery housing 11 as shown in FIG. 1. Upon ignition, the igniter initiates the thermal battery pyrotechnics positioned inside the thermal battery through a provided access 12. The total volume that the thermal battery assembly 16 occupies within munitions is determined by the diameter 17 of the thermal battery housing 11 (assuming it is cylindrical) and the total height 15 of the thermal battery assembly 16. The height 14 of the thermal battery for a given battery diameter 17 is generally determined by the amount of energy that it must produce over the required period of time. For a given thermal battery height 14, the height 13 of the inertial igniter 10 would therefore determine the total height 15 of the thermal battery assembly 16. To reduce the total space that the thermal battery assembly 16 occupies within a munitions housing (usually determined by the total height 15 of the thermal battery), it is therefore important to reduce the height of the inertial igniter 10. This is particularly important for small thermal batteries since in such cases and with currently available inertial igniters, the height of the inertial igniter portion 13 is a significant portion of the thermal battery height 15.

The basic design of the currently available inertial igniters for satisfying the safety (no initiation) requirement when dropped from heights of up to 7 feet (up to 2,000 G impact deceleration with a duration of up to 0.5 msec) is described below using one such embodiment disclosed in U.S. Pat. No. 8,550,001, the contents of which is incorporated herein by reference. An isometric cross-sectional view of this embodiment 200 of the inertia igniter is shown in FIG. 2. The full isometric view of the inertial igniter 200 is shown in FIG. 3. The inertial igniter 200 is constructed with igniter body 201, consisting of a base 202 and at least three posts 203. The base 202 and the at least three posts 203, are preferably integral but may have been constructed as separate pieces and joined together, for example by welding or press fitting or other methods commonly used in the art. The base of the housing 202 is also provided with at least one opening 204 (with a corresponding opening in the thermal battery—such as the opening 12 in FIG. 1) to allow the ignited sparks and fire to exit the inertial igniter into the thermal battery positioned under the inertial igniter 200 upon initiation of the inertial igniter pyrotechnics 204, FIG. 2, or percussion cap primer when used in place of the pyrotechnics as disclosed in such patent.

A striker mass 205 is shown in its locked position in FIG. 2. The striker mass 205 is provided with vertical surfaces 206 that are used to engage the corresponding (inner) surfaces of the posts 203 and serve as guides to allow the striker mass 205 to ride down along the length of the posts 203 without rotation with an essentially pure up and down translational motion. The vertical surfaces 206 may be recessed to engage the inner three surfaces of the properly shaped posts 203.

In its illustrated position in FIGS. 2 and 3, the striker mass 205 is locked in its axial position to the posts 203 by at least one setback locking ball 207. The setback locking ball 207 locks the striker mass 205 to the posts 203 of the inertial igniter body 201 through the holes 208 provided in the posts 203 and a concave portion such as a dimple (or groove) 209 on the striker mass 205 as shown in FIG. 2. A setback spring 210, which is preferably in compression, is also provided around but close to the posts 203 as shown in FIGS. 2 and 3. In the configuration shown in FIG. 2, the locking balls 207 are prevented from moving away from their locking position by the collar 211. The collar 211 is preferably provided with partial guide 212 ("pocket"), which are open on the top as indicated by the numeral 213. The guides may be provided only at the locations of the locking balls 207 as shown in FIGS. 2 and 3, or may be provided as an internal surface over the entire inner surface of the collar 211 (not shown). The advantage of providing local guides 212 is that it would result in a significantly larger surface contact between the collar 211 and the outer surfaces of the posts 203, thereby allowing for smoother movement of the collar 211 up and down along the length of the posts 203. In addition, they would prevent the collar 211 from rotating relative to the inertial igniter body 201 and makes the collar stronger and more massive. The advantage of providing a continuous inner recess guiding surface for the locking balls 207 is that it would require fewer machining processes during the collar manufacture.

The collar 211 can ride up and down the posts 203 as can be seen in FIGS. 2 and 3, but is biased to stay in its upper most position as shown in FIGS. 2 and 3 by the setback spring 210. The guides 212 are provided with bottom ends 214, so that when the inertial igniter is assembled as shown in FIGS. 2 and 3, the setback spring 210 which is biased (preloaded) to push the collar 211 upward away from the igniter base 201, would hold the collar 211 in its uppermost position against the locking balls 207. As a result, the assembled inertial igniter 200 stays in its assembled state and would not require a top cap to prevent the collar 211 from being pushed up and allowing the locking balls 207 from moving out and releasing the striker mass 205.

In this embodiment, a one part pyrotechnics compound 215 (preferably lead styphnate base pyrotechnic material or some other similar compound) is used as shown in FIG. 2. The surfaces to which the pyrotechnic compound 215 is attached are preferably roughened and/or provided with surface cuts, recesses, or the like and/or treated chemically as commonly done in the art (not shown) to ensure secure attachment of the pyrotechnics material to the applied surfaces. The use of one part pyrotechnics compound makes the manufacturing and assembly process much simpler and thereby leads to lower inertial igniter cost. The striker mass is preferably provided with a relatively sharp tip 216 and the igniter base surface 202 is provided with a protruding tip 217 which is covered with the pyrotechnics compound 215, such that as the striker mass is released during an all-fire event and is accelerated down, impact occurs mostly between the surfaces of the tips 216 and 217, thereby pinching the pyrotechnics compound 215, thereby providing the means to obtain a reliable initiation of the pyrotechnics compound 215.

Alternatively, a two-part pyrotechnics compound, e.g., potassium chlorate and red phosphorous, may be used. When using such a two-part pyrotechnics compound, the first part, in this case the potassium chlorate, is preferably provided on the interior side of the base in a provided recess, and the second part of the pyrotechnics compound, in this case the red phosphorous, is provided on the lower surface of the striker mass surface facing the first part of the pyrotechnics compound. In general, various combinations of pyrotechnic materials may be used for this purpose and with an appropriate binder to firmly adhere the materials to the inertial igniter (metal) surfaces.

Alternatively, instead of using the pyrotechnics compound 215, FIG. 2, a percussion cap primer is used. An appropriately shaped striker tip is preferably provided at the tip 216 of the striker mass 205 (not shown) to facilitate initiation upon impact.

Alternatively, the percussion primer or the directly loaded pyrotechnic material may be applied to the striker element and the inertial igniter base be provided with the appropriately shaped tip to initiate ignition as previously described.

The basic operation of the embodiment 200 of the inertial igniter of FIGS. 2 and 3 is now described. In case of any non-trivial acceleration in the axial direction 218 which can cause the collar 211 to overcome the resisting force of the setback spring 210 will initiate and sustain some downward motion of the collar 211. The force due to the acceleration on the striker mass 205 is supported at the dimples 209 by the locking balls 207 which are constrained inside the holes 208 in the posts 203. If the acceleration is applied over long enough time in the axial direction 218, the collar 211 will translate down along the axis of the assembly until the setback locking balls 205 are no longer constrained to engage the striker mass 205 to the posts 203. If the event acceleration and its time duration is not sufficient to provide this motion (i.e., if the acceleration level and its duration are less than the predetermined threshold), the collar 211 will return to its start (top) position under the force of the setback spring 210 once the even has ceased.

If the acceleration time profile is at or higher than its specified all-fire magnitude and duration thresholds, the collar 211 will have translated down passed the locking balls 207, allowing the striker mass 205 to accelerate down towards the base 202. In such a situation, since the locking balls 207 are no longer constrained by the collar 211, the downward force that the striker mass 205 has been exerting on the locking balls 207 will force the locking balls 207 to move outward in the radial direction. Once the locking balls 207 are out of the way of the dimples 209, the downward motion of the striker mass 205 is no longer impeded. As a result, the striker mass 205 accelerates downward, causing the tip 216 of the striker mass 205 to strike the pyrotechnic compound 215 on the surface of the protrusion 217 with the requisite energy to initiate ignition.

In the embodiment 200 of the inertial igniter shown in FIGS. 2 and 3, the setback spring 210 is of a helical wave spring type fabricated with rectangular cross-sectional wires (such as the ones manufactured by Smalley Steel Ring Company of Lake Zurich, Ill.). This is in contrast with the helical springs with circular wire cross-sections used in other available inertial igniters. The use of the rectangular cross-section wave springs or the like has the following significant advantages over helical springs that are constructed with wires with circular cross-sections. Firstly, and most importantly, as the spring is compressed and nears its "solid" length, the flat surfaces of the rectangular cross-section wires come in contact, thereby generating minimal lateral forces that would otherwise tend to force one coil to move laterally relative to the other coils as is usually the case when the wires are circular in cross-section. Lateral movement of the coils can, in general, interfere with the proper operation of the inertial igniter since it could, for example, jam a coil to the outer housing of the inertial igniter (not shown in FIGS. 2 and 3), which is usually desired to house the igniter 200 or the like with minimal clearance to minimize the total volume of the inertial igniter. In addition, the laterally moving coils could also jam against the posts 203 thereby further interfering with the proper operation of the inertial igniter. The use of the present wave springs with rectangular cross-section would therefore significantly increase the reliability of the inertial igniter. The second advantage of the use of the wave springs with rectangular cross-section, particularly since the wires can and are usually made thin in thickness and relatively wide, is that the solid length of the resulting wave spring can be made to be significantly less than an equivalent regular helical spring with circular cross-section. Thus, the total height of the resulting inertial igniter can be reduced. Thirdly, since the coil waves are in contact with each other at certain points along their lengths and as the spring is compressed, the length of each wave is slightly increased, therefore during the spring compression the friction forces at these contact points do certain amount of work and thereby absorb certain amount of energy. The presence of this friction forces ensures that the firing acceleration and very rapid compression of the spring would to a lesser amount tend to "bounce" the collar 211 back up and thereby increasing the possibility that it would interfere with the exit of the locking balls from the dimples 209 of the striker mass 205 and the release of the striker mass 205. The above characteristic of the wave springs with rectangular cross-section should therefore also significantly enhance the performance and reliability of the inertial igniter 200 while at the same time allowing its height (and total volume) to be reduced.

In the embodiment 200 of FIGS. 2 and 3, following ignition of the pyrotechnics compound 215, the generated flames and sparks are designed to exit downward through the opening 204 to initiate the thermal battery below. Alternatively, if the thermal battery is positioned above the inertial igniter 200, the opening 204 can be eliminated and the striker mass could be provided with at least one opening (not shown) to guide the ignition flame and sparks up through the striker mass 205 to allow the pyrotechnic materials (or the like) of a thermal battery (or the like) positioned above the inertial igniter 200 (not shown) to be initiated.

Alternatively, as described in the aforementioned previous art, side ports may be provided to allow the flame to exit from the side of the igniter to initiate the pyrotechnic materials (or the like) of a thermal battery or the like that is positioned around the body of the inertial igniter. Other alternatives known in the art may also be used.

In FIGS. 2 and 3, the inertial igniter embodiment 200 is shown without any outside housing. In many applications, the inertial igniter is placed securely inside the thermal battery, either on the top (FIG. 1) or bottom of the thermal battery housing. This is particularly the case for relatively small thermal batteries. In such thermal battery configurations, since the inertial igniter is inside the hermetically sealed thermal battery, there is no need for a separate housing to be provided for the inertial igniter itself. In this assembly configuration, the thermal battery housing is generally provided with a separate compartment (such as the housing 18 in FIG. 1) for the inertial igniter. The inertial igniter compartment is preferably formed by a member which is fixed to the inner surface of the thermal battery housing, preferably by welding, brazing or very strong adhesives or the like or by certain mechanical means such as provided stops. The separating member (19 in FIG. 1) is provided with an opening 12 to allow the generated flame and sparks following the initiation of the inertial igniter to enter the thermal battery compartment to activate the thermal battery.

The inertial igniter 200, FIGS. 2 and 3 may also be provided with a housing 260 (see FIG. 4). The housing 260 is preferably one piece and fixed to the base 202 of the inertial igniter structure 201, preferably by soldering, laser welding or appropriate epoxy adhesive or any other of the commonly used techniques. The housing 260 may also be crimped to the base 202 at its open end 261, in which case the base 202 is preferably provided with an appropriate recess 262 to receive the crimped portion 261 of the housing 260.

It will be appreciated by those skilled in the art that by varying the mass of the striker 205, the mass of the collar 211, the spring rate of the setback spring 210, the distance that the collar 211 has to travel downward to release the locking balls 207 and thereby release the striker mass 205, and the distance between the tip 216 of the striker mass 205 and the pyrotechnic compound 215 (and the tip of the protrusion 217), the designer of the inertial igniter 200 can try to match the all-fire and no-fire impulse level requirements for various applications as well as the safety (delay or dwell action) protection against accidental dropping from relatively short distances such as from 5-7 feet of the inertial igniter and/or the munitions or the like within which it is assembled.

Briefly, the safety system parameters, i.e., the mass of the collar 211, the spring rate of the setback spring 210 and the dwell stroke (the distance that the collar 210 must travel downward to release the locking balls 207 and thereby release the striker mass 205) must be tuned to provide the required actuation performance characteristics. Similarly, to provide the requisite impact energy, the mass of the striker 205 and the separation distance between the tip 216 of the striker mass and the pyrotechnic compound 215 (and the tip of the protrusion 217) must work together to provide the specified impact energy to initiate the pyrotechnic compound when subjected to the remaining portion of the prescribed initiation acceleration profile after the safety system has been actuated.

The currently available inertial igniters, including the prior art inertial igniters of FIGS. 2 and 3, have been shown to be capable of being designed to provide no-fire safety for accidental drops from a height of up to 5-7 feet, which may subject the inertial igniter to accelerations of the order of 2,000 Gin the direction of its activation for a duration of up to 0.5 milliseconds. However, drops from heights of up to 40 feet can subject inertial igniters to accelerations of up to 18,000 Gs in the direction of their activation for over 1 millisecond. The latter accidental drops, for example due to drops during loading into ships by cranes, may thereby subject the inertial igniter to impulses that are higher or are close to those generated by the firing setback acceleration. Thus, the currently available methods of designing inertial igniters are not suitable for the design of inertial igniters that can withstand accidental drops from heights of up to 40 feet.

In the case of munitions that are fired by rifled gun barrels or are provided with other means of being spin accelerated during firing to certain barrel exit linear velocity as well as spin rate, or the so-called spin-stabilized munitions, the munitions is subjected simultaneously to both a linear setback acceleration profile as well as a spin acceleration profile. However, when munitions are subjected to accidental drops, even from great heights, or nearby explosions or the like, it is impossible for them to be subjected simultaneously to both high firing setback induced linear as well as spin accelerations. This characteristics of the firing of spin stabilized munitions of various kinds is used to develop the following methods for the design of inertial igniters and electrical switches and for the construction of inertial igniters and electrical switches that are required to detect the prescribed all-fire setback induced and simultaneous spin acceleration as well as linear accelerations for initiation, thereby also making then satisfy the required no-fire 40 feet drops, which could subject the inertial igniters and electrical switches to acceleration of up to 18,000 Gs in the direction of their activation for up to and possibly over 1 millisecond.

In the following inertial igniter and electrical switch embodiments of the present invention, the methods used for the development of the inertial igniter and electrical switch mechanisms are based on using either the firing setback induced linear or spin acceleration event to arming the device (enabling the device for activation) and use the other to initiate the device. That is, if setback induced linear acceleration is used to arm (enable) the device (either the inertial igniter or the electrical switch), then the spin acceleration is used for initiation (activation). On the other hand, if setback induced spin acceleration is used to arm (enable) the device (either the inertial igniter or the electrical switch), then the linear acceleration is used for initiation (activation).

SUMMARY

A need therefore exists for methods to design mechanical inertial igniters that could satisfy high-height drop safety (no-fire) requirements while satisfying relatively low all-fire firing (setback) acceleration requirement.

A need also exists for methods to design mechanical inertial igniters that would initiate only when subjected simultaneously to firing setback induced spin and linear acceleration and do not initiate when subjected any of the aforementioned no-fire events.

A need also exists for mechanical inertial igniters that are developed based on the above methods and that can satisfy the safety requirement of drops from high-heights of up to 40 feet that could generate impact induced deceleration rates of up to 18,000 Gs or even higher over a duration of 1 millisecond or higher.

Accordingly, methods are provided that can be used to design fully mechanical inertial igniters that can satisfy high-height drop safety (no-fire) requirements for munitions fired from rifled gun barrels, i.e., munitions that are spin accelerated during firing, while satisfying relatively low all-fire firing (setback) acceleration level requirement. In addition, several embodiments are also provided for the design of such high-height-drop-safe inertial igniters for use in gun-fired munitions, mortars and the like.

An inertial igniter that combines such a safety system with an impact based initiation system and its alternative embodiments are described herein together with alternative methods of pyrotechnics initiation.

Such inertial igniters may be used to initiate reserve batteries such as thermal batteries and liquid reserve batteries as well as various initiation trains.

The methods to design fully mechanical mechanisms are particularly suitable for inertial igniters, but may also be used in other similar applications, for example as so-called electrical G-switches that open (or close) an electrical circuit only when the device is subjected the prescribed simultaneous setback induced linear and spin acceleration profile threshold. Here, it is appreciated that the setback acceleration profile threshold to for inertial igniter and G-switch activation consists of a prescribed acceleration magnitude threshold as well as a prescribed duration threshold of the prescribed acceleration magnitude threshold. It is therefore appreciated by those skilled in the art that the electrical switch embodiments of the present invention activate upon sensing of the setback acceleration induced impulse and not just its acceleration magnitude and a more appropriate name for them being "impulse-Switch". However, hereinafter and for the sake of avoiding confusion by current users of, the terms "G-switch" is used to also indicate the "Impulse-Switch".

Also disclosed are several inertial igniter embodiments that combine such mechanical mechanisms (safety systems) with impact based initiation systems. Also disclosed are several electrical G-switches that open (or close) an electrical circuit only when the device is subjected the prescribed simultaneous setback induced linear and spin acceleration profile threshold.

A need also therefore exists for the development of novel methods and resulting mechanical G-switches for use in gun fired munitions, small rockets or other similar applications that can be used to open (close) a normally closed (open) electrical circuitry or the like upon the device using such G-switch experiencing a prescribed simultaneous setback induced linear and spin acceleration profile threshold. Such G-switches must occupy relatively small volumes and do not require external power sources for their operation.

In many gun-fired munitions and other similar applications, such G-switches must not operate when dropped, e.g., from up to 40 feet onto a hard ground (generally corresponding to acceleration levels of up to 2,000 G for a duration of up to 0.5 msec) for certain applications, and from up to 40 feet (generally corresponding to acceleration levels of up to 18,000 G for a duration of up to 1 msec) for certain other applications.

Accordingly, methods are provided that can be used to design fully mechanical G-switches that can satisfy high-height drop safety (no-fire) requirements for munitions fired from rifled gun barrels, i.e., munitions that are spin accelerated during firing, while satisfying relatively low all-fire firing (setback) acceleration level requirement. In addition, several embodiments are also provided for the design of such high-height-drop-safe inertial igniters for use in gun-fired munitions, mortars and the like.

It is, therefore, highly desirable to develop inertial igniters that are smaller in height and also preferably in volume for thermal batteries in general and for small thermal batteries in particular. This is particularly the case for inertia igniters for gun-fired munitions that experience high G firing setback accelerations levels, e.g., setback acceleration levels of 10-30,000 Gs or even higher, since such thermal batteries would have significantly higher no-fire and all-fire acceleration requirements, which should allow the development of inertial igniters that are smaller in height and possibly even in volume.

A need therefore exists for novel miniature mechanical inertial igniters for reserve batteries such as thermal batteries and liquid reserve batteries and for initiation trains used in gun-fired munitions, mortars, rockets and the like, particularly for small and low power reserve batteries that could be used in fuzing and other similar applications, that are safe (i.e., do not initiate) when dropped from relatively high-heights, such as up to 40 feet. Dropping from heights of up to 40 feet have been shown that can subject the device to impact deceleration levels of up to 18,000 Gs with the duration of up to and sometimes over 1 msec. Such innovative inertial igniters are highly desired to be scalable to reserve batteries and initiation trains of various sizes, in particular to miniaturized inertial igniters for small size thermal batteries. Such inertial igniters are generally also required not to initiate if dropped from heights of up to 7 feet onto a concrete floor, which can result in impact induced inertial igniter decelerations of up to of 2000 G that may last up to 0.5 msec. The inertial igniters are also generally required to withstand high firing accelerations, for example up to 20-50,000 Gs (i.e., not to damage the thermal battery); and should be able to be designed to ignite at specified acceleration levels when subjected to such accelerations for a specified amount of time based on the firing acceleration profile. High reliability is also of much concern in inertial igniters. In addition, the inertial igniters used in munitions are generally required to have a shelf life of better than 20 years and could generally be stored at temperatures of sometimes in the range of −65 to 165 degrees F. This requirement is usually satisfied best if the igniter pyrotechnic is in a sealed compartment. The inertial igniter designs must also consider the manufacturing costs and simplicity in the designs to make them cost effective for munitions applications.

To ensure safety and reliability, inertial igniters should not initiate during acceleration events which may occur during manufacture, assembly, handling, transport, accidental drops, etc. Additionally, once under the influence of an acceleration profile particular to the firing of ordinance from a gun, the device should initiate with high reliability. It is also conceivable that the igniter will experience incidental low but long-duration accelerations, whether accidental or as part of normal handling, which must be guarded against initiation. Again, the impulse given to the miniature inertial igniter will have a great disparity with that given by the initiation acceleration profile because the magnitude of the incidental long-duration acceleration will be quite low.

Those skilled in the art will appreciate that the inertial igniters disclosed herein may provide one or more of the following advantages over prior art inertial igniters:

provide inertial igniters that are safe when dropped from very high-heights of up to 40 feet;

provide inertial igniters that allow the use of standard off-the-shelf percussion cap primers or commonly used one part or two part pyrotechnic components;

provide inertial igniters that can be sealed to simplify storage and increase their shelf life; and provide inertial igniters that must simultaneously detect firing setback induced spin as well as linear acceleration for activation.

Accordingly, inertial igniters for use with reserve batteries such as thermal batteries and liquid reserve batteries for producing power as well as for igniting initiation trains upon a specified acceleration profile are provided.

BRIEF DESCRIPTION OF THE DRAWINGS

These and other features, aspects, and advantages of the apparatus of the present invention will become better understood with regards to the following description, appended claims, and accompanying drawings where:

DETAILED DESCRIPTION OF THE PREFERRED EMBODIMENT

Figure 1:
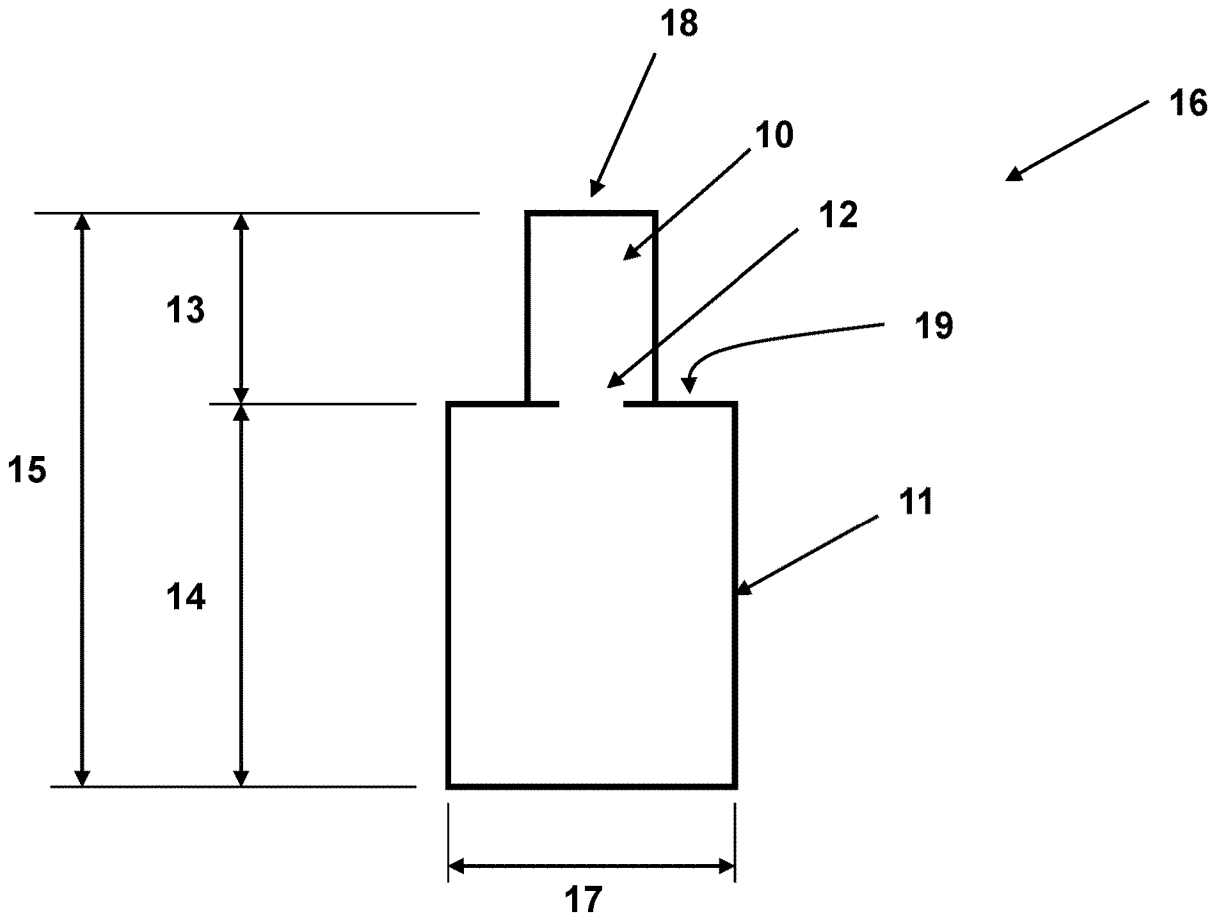
Figure 1 (PRIOR ART)
FIG. 1 illustrates a schematic of a thermal battery and inertial igniter assembly of the prior art.
Figure 2:
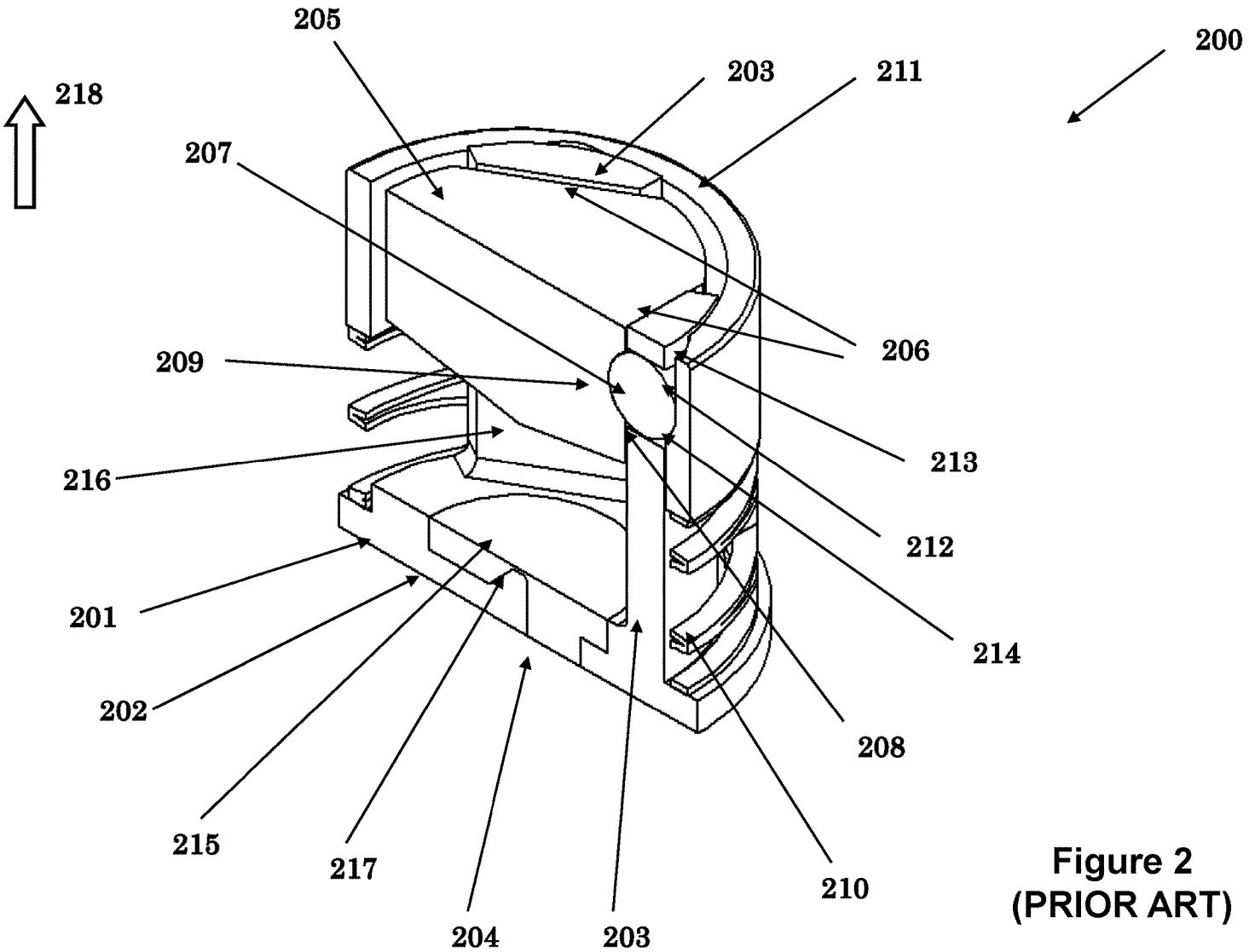
Figure 2 (PRIOR ART)
FIG. 2 illustrates a schematic of a cross-section of an inertial igniter for thermal battery described in the prior art.
Figure 3:
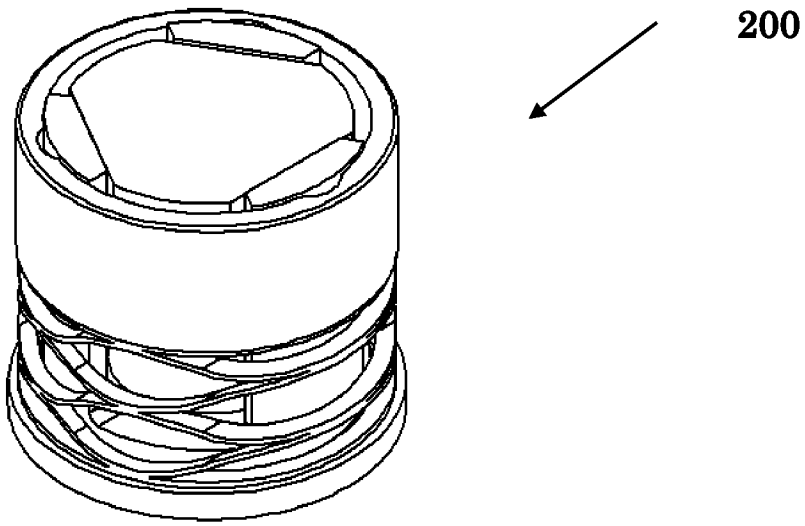
Figure 3 (PRIOR ART)
FIG. 3 illustrates a schematic of the isometric drawing of the inertial igniter for thermal battery of FIG. 2.
Figure 4:
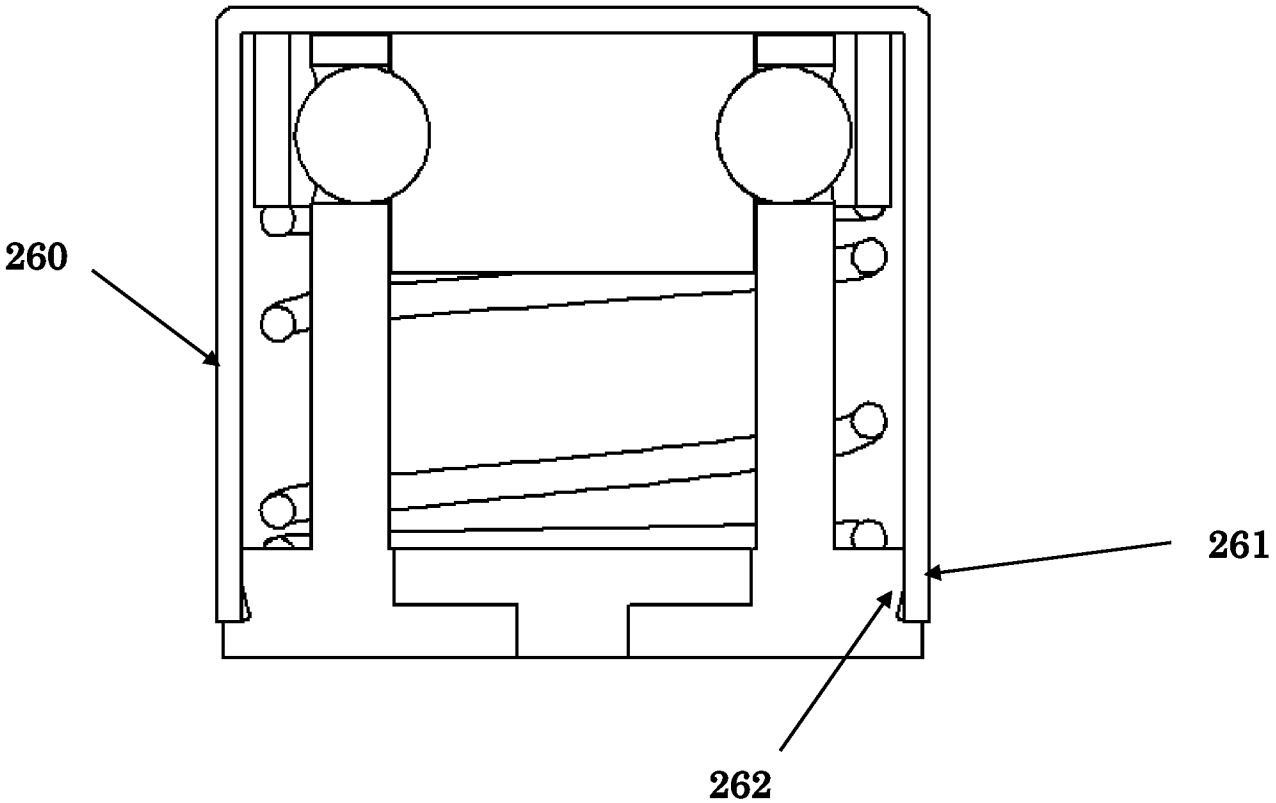
Figure 4 (Prior Art)
FIG. 4 illustrates a schematic of cross-section of an inertial igniter for thermal battery described in the prior art with an outer housing.
Figure 5:
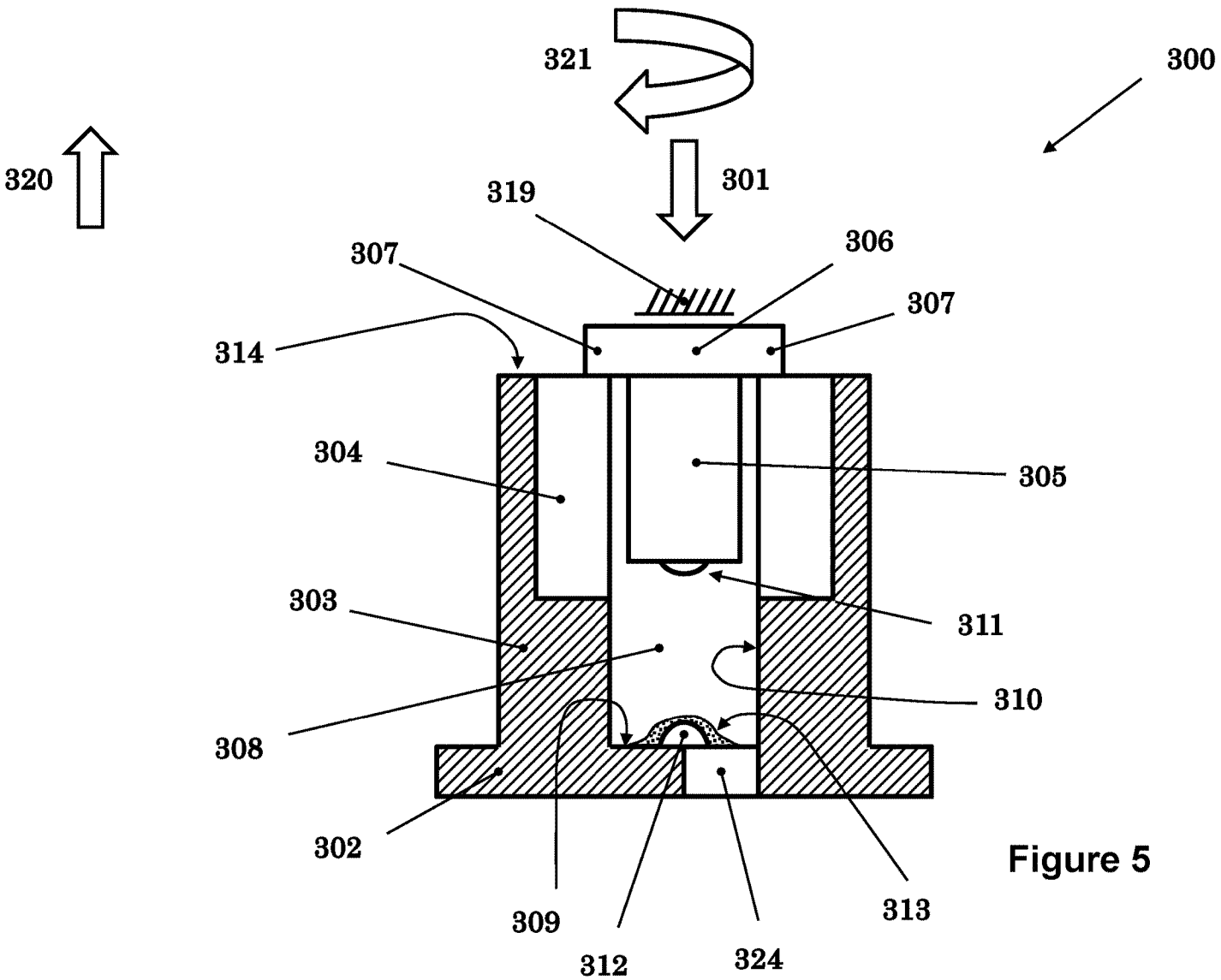
FIG. 5 illustrates a schematic cross-section of the first inertial igniter embodiment with firing setback spin acceleration arming (enabling) and linear acceleration initiation.
Figure 6:
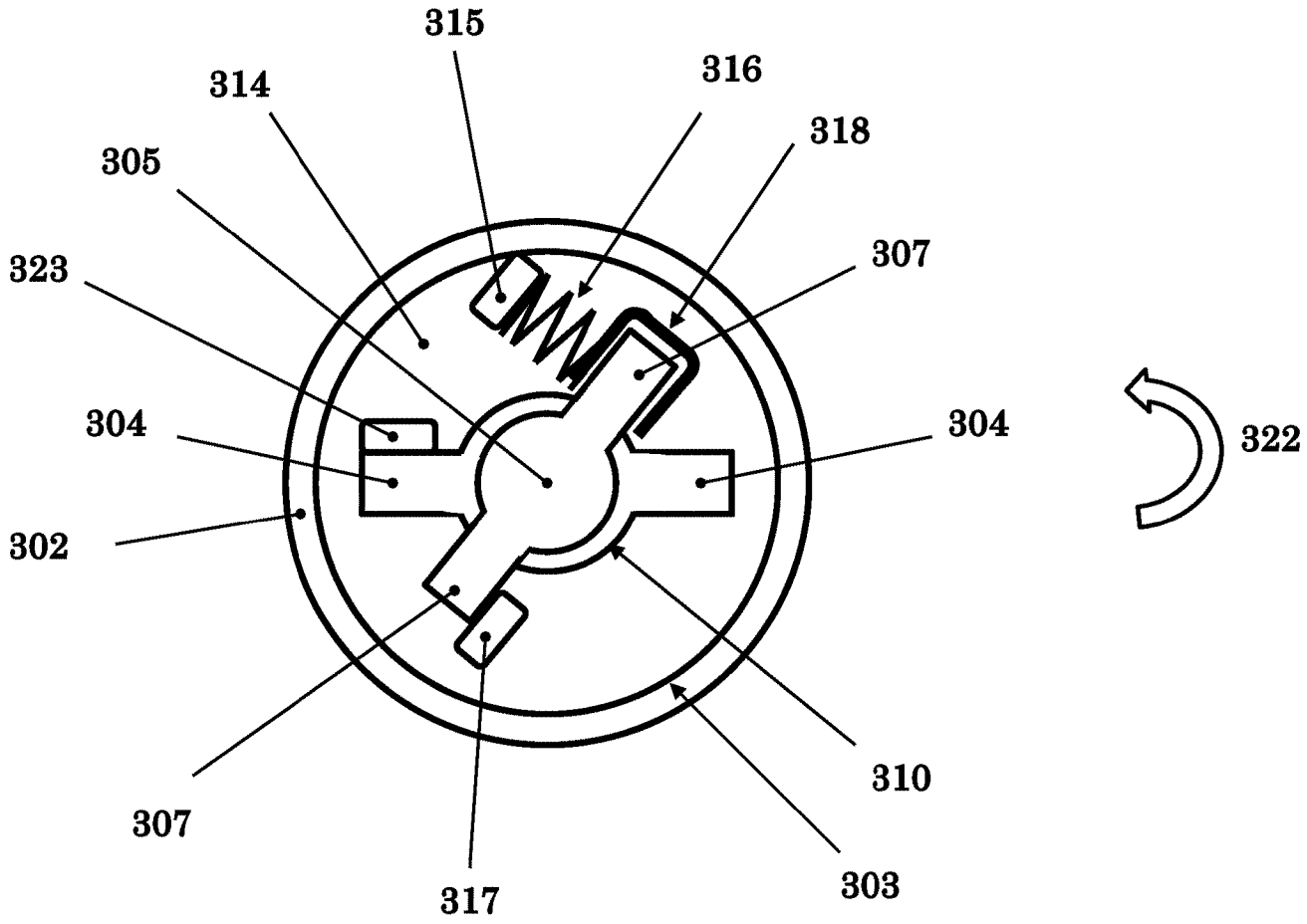
FIG. 6 illustrates the top view of the inertial igniter embodiment of FIG. 5.

A schematic of a cross-sectional view of a first embodiment 300 of an inertial igniter is shown in FIG. 5. The top view of the inertial igniter 300 as observed in the direction of the arrow 301 is shown in FIG. 6. The inertial igniter 300 can be cylindrical in shape since most thermal batteries are constructed in cylindrical shapes, but may be constructed in any other appropriate geometry to fit the intended application at hand. The inertial igniter 300 consists of a base element 302, which in a thermal battery construction shown in FIG. 1 would be positioned in the housing 18 with the base element 302 positioned on the top of the thermal battery cap 19.

In the embodiment 300, the inertial igniter body 303, which can be integral to the base element 302, is provided with a cylindrical open compartment 308, which can have a circular cross-section, and which extends to or close to the base element 302, the bottom surface of the open compartment 308 is indicated by numeral 309 in FIG. 5. In FIGS. 5 and 6, the surface of the cylindrical open compartment 308 is indicated by the numeral 310. The cylindrical open compartment 308 is provided with at least one guide 304 that runs down towards the base 302 a certain distance down the body 303 as shown in FIG. 5. In an embodiment 300, two opposing guides 304 are provided in the inertial igniter body 303 for the sake of symmetry and to minimize lateral rotations of the striker mass 305 following inertial igniter arming (enabling) as described below.

The striker mass 305 has a main cylindrical body with a top portion 306 with at least one end 307, which are shaped to ride in the guides 304 of the inertial igniter structure body 303 as shown in FIGS. 5 and 6. In an embodiment 300, two opposing guides 304 are provided in the inertial igniter body 303 to accommodate two ends 307 of the top portion 306 of the striker mass 305 as shown in FIGS. 5 and 6 for the sake of symmetry and to minimize lateral rotations of the striker mass 305 following inertial igniter arming (enabling) as described later in this disclosure.

In addition, in FIGS. 5 and 6 the guides 304 in the inertial igniter body 303 and the mating ends 307 of the top portion 306 of the striker mass 305 are shown to be square with sharp ends. It will be, however, appreciated by those skilled in the art that in practice, the guides 304 can take other shapes, such as semi-circular in cross-section or have semi-circular ends for ease of manufacturing. The mating ends 307 of the top portion 306 of the striker mass 305 can be semi-circular to eliminate sharp corners and mate well with the guides 304. In general, the mating surfaces are provided with minimal clearances to minimize rocking action of the striker mass 305 as it travels downwards towards the inertial igniter base 302.

The striker mass 305 can be provided with a relatively sharp tip 311 and the cylindrical open compartment 308 bottom surface 309 can be provided with a protruding tip 312, which is covered with a pyrotechnics compound 313, such that as the striker mass 305 is released during an all-fire event and is accelerated down, impact occurs mostly between the surfaces of the tips 311 and 312, thereby pinching the pyrotechnics compound 313, thereby providing the means to obtain a reliable initiation of the pyrotechnics compound 313.

Alternatively, a two-part pyrotechnics compound, e.g., potassium chlorate and red phosphorous, may be used. When using such a two-part pyrotechnics compound, the first part, in this case the potassium chlorate, can be provided on the interior side of the base in a provided recess, and the second part of the pyrotechnics compound, in this case the red phosphorous, can be provided on the lower surface of the striker mass surface facing the first part of the pyrotechnics compound. In general, various combinations of pyrotechnic materials may be used for this purpose and with an appropriate binder to firmly adhere the materials to the inertial igniter (metal) surfaces.

Alternatively, instead of using the pyrotechnics compound 313, FIG. 5, a percussion cap primer can be used. An appropriately shaped striker tip can be provided at the tip 311 of the striker mass 305 (not shown) to facilitate initiation upon impact.

Alternatively, the percussion primer or the directly loaded pyrotechnic material may be applied to the striker element 305 and the bottom surface 309 can be provided with the appropriately shaped tip to initiate ignition as previously described.

On a top surface 314 of the inertial igniter body 303, a support element 315 is provided and to which one end of a tensile spring (elastic) element 316 is attached. The other end of said tensile spring 316 is attached to a U-shaped holding member 318 inside which one end 307 of the top portion 306 of the striker mass 305 is held as shown in FIG. 6. A stop 317 is also provided on the top surface 314 of the inertial igniter body 303 (not shown in FIG. 5 for the sake of clarity), against which the other end 307 of the top portion 306 of the striker mass 305 rests to limit the rotation of the striker mass 305 in the counterclockwise direction.

The tensile spring 316 may be preloaded in tension so that it would resist a prescribed level of toque applied to the striker mass 305 in the direction perpendicular to the plane of FIG. 6 which would tend to rotate the striker mass in the clockwise direction.

In the schematic of FIG. 6 and for purpose of demonstrating the basic design and operation of the inertial igniter embodiment 300, only one tensile spring 316 is shown to provide the means of biasing the striker mass 305 rotation in the counterclockwise direction. Similarly, only one stop 317 is provided to limit counterclockwise rotation of the striker mass 305. It is, however, appreciated by those skilled in the art that in practice, counteracting tensile springs can be used to generate a pure couple on the striker mass 305 in the direction of its long axis (perpendicular to the plane of the FIG. 6), for example by either using two opposing tensile springs on either side of the striker mass or by using a torsion type spring. Thus, as a result, the lateral forces acting on the striker mass 305 are minimized and the striker mass motion relative to the inertial igniter body 303 as described below can be expected to become smoother.

It will be appreciated by those skilled in the art that instead of the tensile spring 316 shown in FIG. 6, compressive or leaf type or in fact any other elastic element, that applies similar biasing rotational torque to the striker mass about the direction perpendicular to the plane of FIG. 6 may also be used.

It will be appreciated that the inertial igniter 300 is usually packaged in the thermal battery or any other device within a space which provides a rigid stop 319, FIG. 5, to prevent the striker mass 305 from moving out of the inertial igniter body 303. When such a space is not provided, then a separate rigid stop element 319 is fixedly attached to the inertial igniter body 303 to prevent the same effect.

The basic operation of the inertial igniter embodiment 300 of FIGS. 5 and 6 is now described. In case of any non-trivial linear acceleration in the axial direction indicated by the arrow 320 in FIG. 5 (which corresponds to the direction of munitions firing, i.e., the direction of firing setback acceleration), the stop 319 prevents upward motion and the upper surface 314 of the inertial igniter body, being in contact with the ends 307 of the top portion 306, prevent downward motion of the striker mass 305 relative to the inertial igniter body 303. It is noted that the arrow 320 is intended to indicate the direction of the firing setback acceleration to munitions to which the base 302 and/or the body 303 of the inertial igniter 300 is fixedly attached.

In addition, if the inertial igniter is subjected to a spin acceleration in the clockwise direction about its long axis (perpendicular to the plane of the FIG. 6 and as indicated by the arrow 321 in FIG. 5 and arrow 322 in FIG. 6), then the stop 317 would prevent the striker mass from rotation about the axis relative to the inertial igniter body 303.

However, if the inertial igniter is subjected to a spin acceleration in the counterclockwise direction about its long axis, assuming no friction between the surfaces of the striker mass 305 and the inertial igniter body 303, in the absence of the spring 316 (FIG. 6), the device body 303 would begin to rotate in the counterclockwise direction while the striker mass 305 would stay stationary. However, in the presence of the preloaded tensile spring 316, as the inertial igniter body 303 begins to rotate in the counterclockwise direction, the preloaded tensile spring 316 tends to extend and reduce its tensile preloading force if the (inertial) resistance of the striker mass 305 to the applied counterclockwise acceleration is larger than resisting torque applied to the striker mass by the preloaded tensile spring 316. Noting that the inertial resistance of the striker mass is due to its moment of inertial about its long axis (axis of its rotation relative to the inertial igniter body 303). Otherwise the end 307 of the top portion 306 striker mass 305 is forced by the preloaded tensile spring to stay in contact with the stop 317, FIG. 6, and the striker mass 305 does not undergo any rotation relative to the inertial igniter body 303 and is accelerated together with the inertial igniter body 303.

However, if the spin acceleration applied to the inertial igniter body in the counterclockwise direction is high enough for the resulting resisting inertial torque of the striker mass 305 to overcome the tensile preloading force of the spring 316, then the tensile spring 316 will begin to extend, thereby allowing the striker mass 305 to rotate in the clockwise direction relative to the inertial igniter body 303. If the spin acceleration magnitude is at or above the prescribed threshold and continues for its prescribed duration threshold, then the tensile spring 316 would be extended long enough to allow counterclockwise rotation of the striker mass 305 relative to the inertial igniter body 303 to position the tips 307 of the striker mass 305 over the guides 304 of the inertial igniter body 303. As can be seen in the top view of FIG. 6, a stop 323 that is fixedly attached to the top surface 314 of the inertial igniter body 303 is also provided to prevent rotation of the tips 307 past the guides 304.

It will be appreciated by those skilled in the art that once the tips 307 of the striker mass 305 are positioned over the guides 304 of the inertial igniter body 303, then the striker mass 305 is free to move down the cylindrical open compartment 308 of the inertial igniter body 303 towards the base 302. The inertial igniter 300 is therefore considered to be armed (enabled) to respond to the linear setback acceleration and ignite the pyrotechnic material 313 as previously described.

Once the inertial igniter 300 is armed (enabled) by the applied spin acceleration of magnitude and duration corresponding to the prescribed all-fire setback induced spin acceleration profile threshold, the setback linear acceleration would accelerate the striker mass 305 downward and cause the tip 311 of the striker mass to impact the pyrotechnic covered protruding tip 312 of the bottom surface 309 of the cylindrical open compartment 308, thereby pinching the pyrotechnics compound 313, thereby initiating the pyrotechnics compound 313. Following ignition of the pyrotechnics compound 313, the generated flames and sparks are designed to exit downward through the opening 324 to initiate the pyrotechnic materials of the thermal battery or any other pyrotechnic or similar material below.

It will be appreciated by those skilled in the art that once the inertial igniter 300 is armed by the spin acceleration of magnitude and duration corresponding to the prescribed all-fire setback induced spin acceleration profile threshold, the magnitude of the linear (setback) acceleration (in the direction of the arrow 320) must be high enough so that as the striker mass 305 is accelerated down towards the base 302 of the inertial igniter it would gain enough speed and thereby kinetic energy to ignite the pyrotechnic compound 313 as the striker mass tip 311 impacts the pyrotechnic compound covering the protruding tip 312 of the bottom surface 309.

Figure 7A:
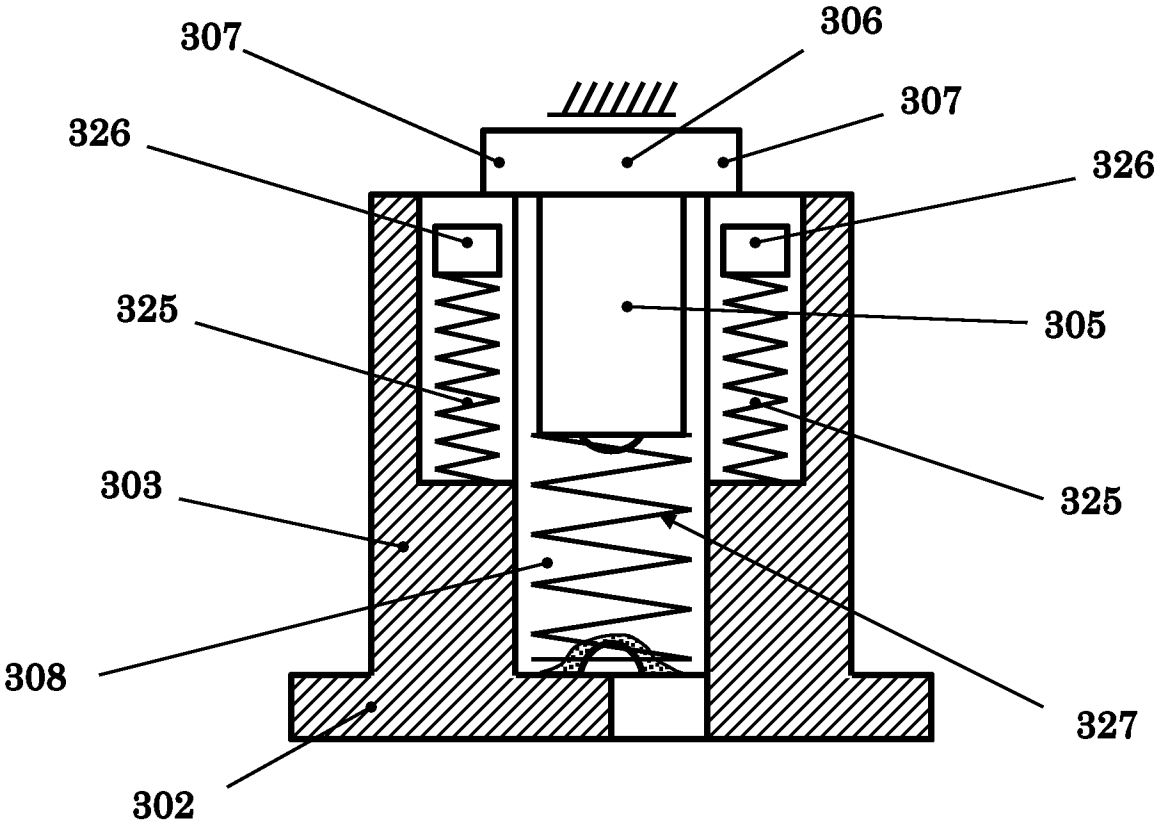
FIG. 7A illustrates a schematic cross-section of a modified construction of the first inertial igniter embodiment with firing setback spin acceleration arming (enabling) and linear acceleration initiation of FIGS. 5 and 6.

It will be appreciated by those skilled in the art that the aforementioned spin acceleration threshold required to arm (enable) the inertial igniter 300 of FIGS. 5 and 6 and the parameters and preloading level of the tension spring 316 must be selected such that considering the munitions firing spin acceleration magnitude and duration profile has enough duration to rotate the striker mass 305 clockwise relative to the inertial igniter body to its arming (enabling) position and allow the striker mass 305 to be accelerated downward to the required velocity to reliably initiate the pyrotechnic compound 313. However, if the firing setback profile threshold does not provide the required duration for the indicated arming and striker mass acceleration to the required pyrotechnic initiation velocity, then the striker mass 305 of the inertial igniter 300 of FIGS. 5 and 6 will stay in the cylindrical open compartment 308 of the inertial igniter body 303, and could possibly initiate the pyrotechnic compound 313 at certain time, for example due to flight vibration, impact, accidental drops, or other similar events. To avoid such conditions, compressive spring (elastic) elements may be provided to push back the striker mass 305 away from the base 302 of the inertial igniter body. Two possible embodiments of the inertial igniter 300 of FIGS. 5 and 6 are shown in the schematic of FIG. 7A. It is appreciated by those skilled in the art that and numerous other return spring designs and configurations are also possible and those illustrated in the schematic of FIG. 7A should be considered only as two of such design examples.

In one modified inertial igniter embodiment 300 of FIGS. 5 and 6 shown in FIG. 7A, at least one spring (elastic) element 325 is provided inside the guides 304 of the inertial igniter body 303. The spring 325 is at its free length and can be provided with a solid member 326 to provide a relatively flat top surface. Then when the inertial igniter 300 is armed and the tips 307 of the top side 306 of the striker mass 305 begin to move down the guides 304, FIG. 5, the tips 307 come first into contact with the solid member 326 and begin to deform the spring 325 in compression. Then if the magnitude of the linear (setback) acceleration is high enough (i.e., at or above the prescribed threshold) to allow the striker mass 305, FIG. 5, to be accelerated down towards the base 302 of the inertial igniter with the required kinetic energy, the striker mass tip 311 would impact the pyrotechnic compound 313 covering the protruding tip 312 of the bottom surface 309 and initiate it as was previously described. Otherwise if the linear acceleration is below the prescribed all-fire threshold, the springs 325 are compressed certain amount but not enough to allow the striker mass tip 311 to reach the pyrotechnic compound 313 and the inertial igniter 300 is not initiated.

In an alternative modification of the inertial igniter embodiment 300 of FIGS. 5 and 6 shown in FIG. 7A, a spring (elastic) element 327 is provided inside the cylindrical open compartment 308 of the inertial igniter body 303 between its bottom surface 309 and the striker mass 305 as shown in FIG. 7A. The spring 327 would then perform the same function as the springs 325.

It will be appreciated by those skilled in the art that the springs 325 and 327 shown in FIG. 7A for the above two modifications of the inertial igniter embodiment of FIGS. 5 and 6 must generally have relatively low stiffness (spring rate) so that they would not demand excessive linear (setback) acceleration for inertial igniter initiation.

Figure 7B:
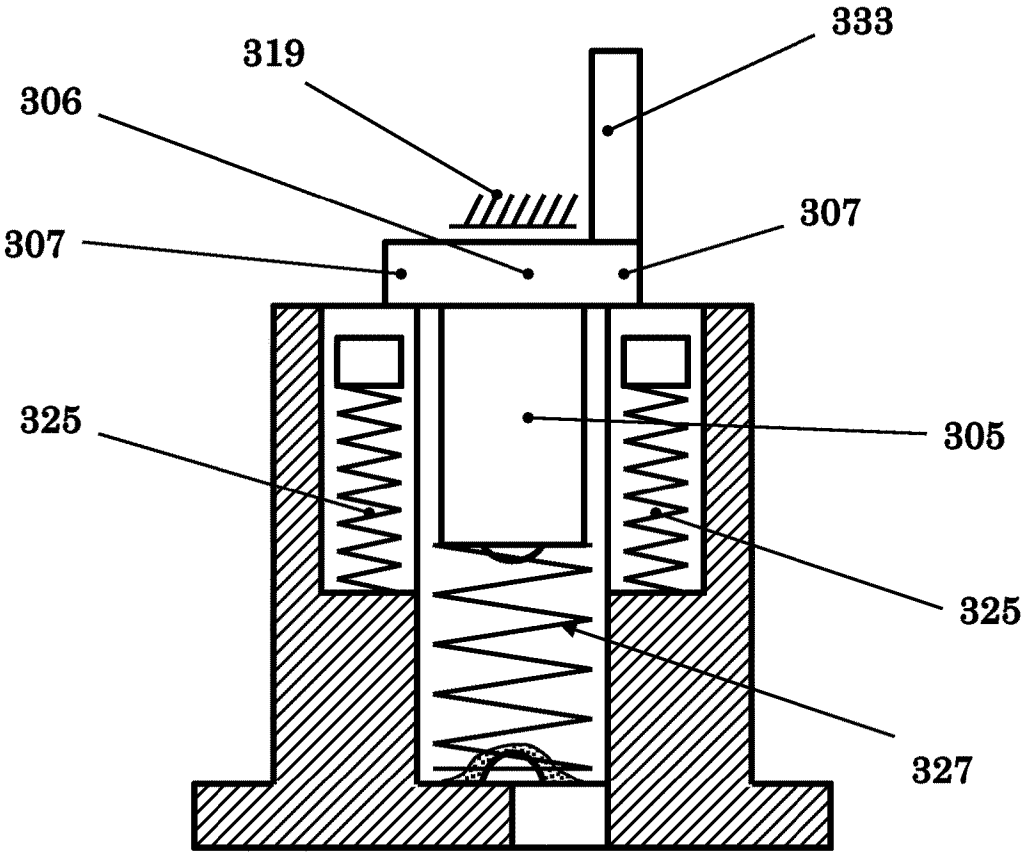
FIG. 7B illustrates a schematic cross-section of a modified construction of the inertial igniter embodiment of FIG. 7A.

It will also be appreciated by those skilled in the art that as can be seen in the schematic of FIG. 6, once the striker mass 305 is armed and begins to move down towards the base 302, the U-shaped holding member 318 inside which one end 307 of the top portion 306 of the striker mass 305 is held is released. Thus, in the aforementioned case in which the armed inertial igniter does not ignite the pyrotechnic material 313 and that the striker mass 305 is pushed up by the springs 325 and/or 327, the end 307 of the top portion 306 of the striker mass cannot re-engage the U-shaped holding member 318 and be pulled back by a preloaded tensile spring 316 to it prior-arming (disarmed) position shown in FIG. 6. The inertial igniter embodiments of FIG. 7A can, however, be readily modified to allow the striker mass 305 to be returned to its prior-arming (disarmed) position shown in FIG. 6 by extending the portion of the end 307 that engages the U-shaped holding member 318 as shown in the schematic of FIG. 7B. The extension, indicated by the numeral 333 in FIG. 7A, will then stay engaged with the U-shaped holding member 318 at all times before and after inertial igniter arming as the striker mass 305 moves down towards the inertial igniter base 302. Then as the striker mass 305 is pushed up by the springs 325 and/or 327, extension 333 rides back in the U-shaped holding member 318 until the preloaded tensile spring 316 can rotate the striker mass to it prior-arming (disarmed) position shown in FIG. 6.

In the inertial igniter embodiment 300 of FIGS. 5 and 6, the spin acceleration threshold required to arm (enable) the inertial igniter and the parameters and preloading level of the tension spring 316 are selected such that considering the munitions firing spin acceleration magnitude and duration profile, following previously described arming action, the linear setback acceleration persists long enough at or beyond the prescribed threshold so that the striker mass 305 can be accelerated downward towards the base 302 of the inertial igniter to the required velocity (kinetic energy) for reliably initiating the pyrotechnic compound 313 as the striker mass tip 311 impacts the pyrotechnic compound 313 covering the protruding tip 312 of the bottom surface 309 of the compartment 308, FIG. 5. However, if the firing setback profile threshold does not provide the required duration for the indicated arming of the inertial igniter and striker mass acceleration to the required velocity for reliable initiation of the pyrotechnic compound 313, then the striker mass 305 of the inertial igniter 300 of FIGS. 5 and 6 will be released and may gain a fraction of the required velocity but may or may not be able to initiate the pyrotechnic compound. Such relatively short duration firing setback acceleration profiles are common in many munitions, particularly in many medium caliber or the like munitions. The next disclosed embodiment is intended to provide the means of addressing this issue for short duration firing setback acceleration applications.

Figure 8:
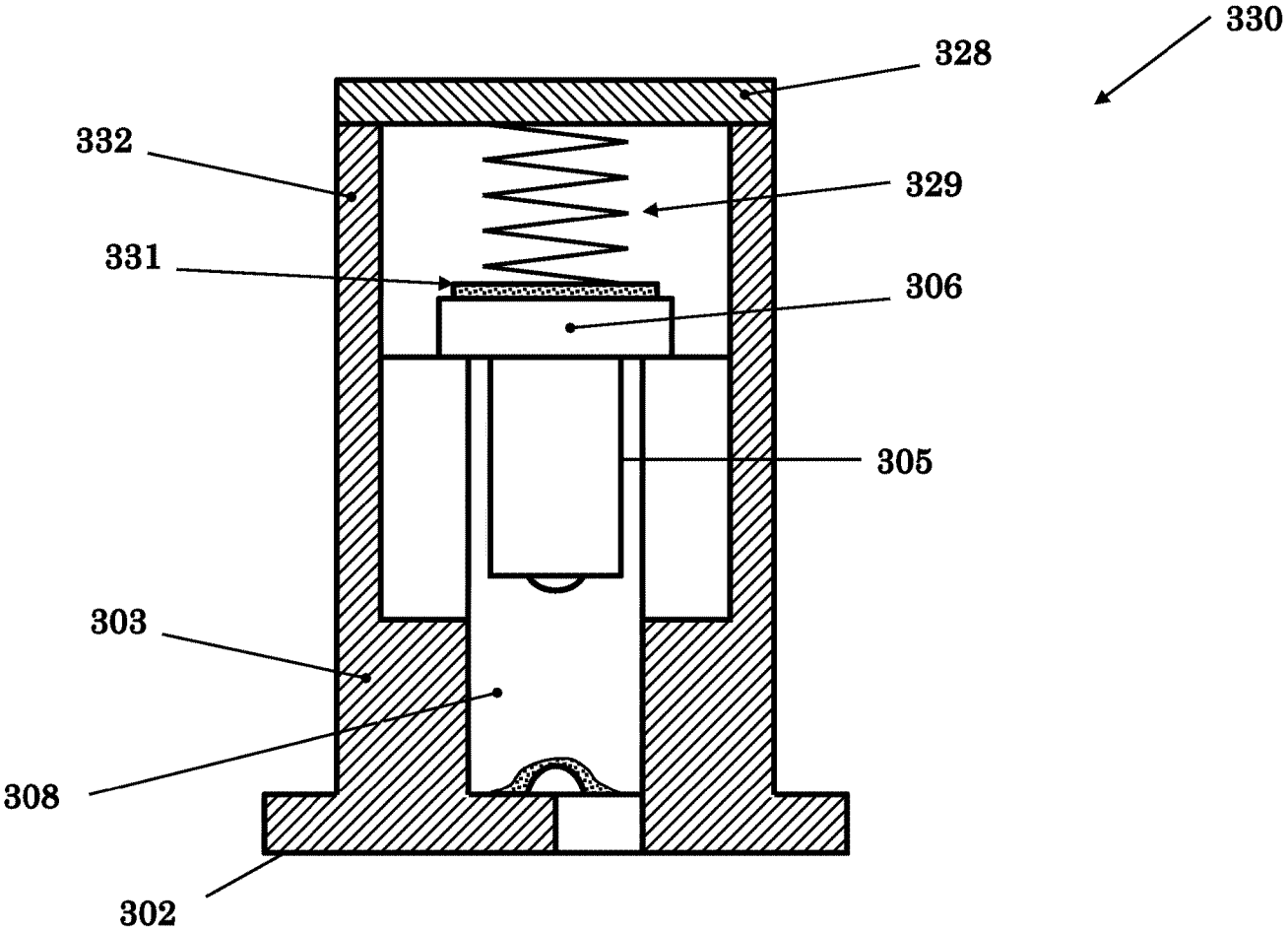
FIG. 8 illustrates a schematic cross-section of the second inertial igniter embodiment with firing setback spin acceleration arming (enabling) and linear acceleration initiation.

The schematic of the cross-sectional view of a second embodiment 330 of the inertial igniter which is designed for reliable inertial igniter initiations for munitions with short duration firing setback acceleration profiles is shown in FIG. 8. The inertial igniter embodiment 330 is identical to the embodiment 300 of FIGS. 5 and 6, except for the following. Firstly, the inertial igniter body 303 is extended beyond its top surface 314 as indicated by the numeral 332, such as in a shape of a cylindrical shell with a thickness which is radially slightly past the guides 304 openings to allow for their ease of machining. A top cover 328 is also fixedly attached to the top of the provided extension 322. Secondly, a preloaded compressive spring (elastic member) 329 is provided between the top cover 328 and the top side 306 of the striker mass 305 as shown in FIG. 8. A low friction member 331 is also provided between the preloaded compressive spring 329 and the contacting surface of the top side 306 of the striker mass 305 as shown in FIG. 8 to minimize friction generated torque as the striker mass 305 rotates along its long axis during the aforementioned process of inertial igniter arming (enabling).

If a spin acceleration is applied to the inertial igniter body 303 in the counterclockwise direction (as indicated by the direction of the arrows 321 and 322 in FIGS. 5 and 6, respectively) and its magnitude is equal or larger than the prescribed all-fire magnitude threshold, then the striker mass 305 rotates in the clockwise direction relative to the inertial igniter body 303 until the tips 307 of the striker mass 305 are positioned over the guides 304 of the inertial igniter body 303 as was previously described. The striker mass 305 is then free to move down the cylindrical open compartment 308 of the inertial igniter body 303 towards the base 302, FIGS. 5 and 8, and the inertial igniter 300 is armed (enabled). At this point, the force exerted by the preloaded compressive spring 329 begins to accelerate the striker mass 305 towards the inertial igniter base 302. With a properly designed and preloaded compressive spring 329, the striker mass 305 is accelerated downward towards the base of the inertial igniter to the required velocity (kinetic energy) for reliably initiating the pyrotechnic compound 313 as the striker mass tip 311 impacts the pyrotechnic compound 313 covering the protruding tip 312 of the bottom surface 309 of the compartment 308, FIG. 5, and the generated flames and sparks exit downward through the opening 324 to initiate the pyrotechnic materials of the thermal battery or any other pyrotechnic or similar material below.

It will be appreciated by those skilled in the art that in cases in which the setback acceleration duration is long enough such that after the inertial igniter embodiment 330 of FIG. 8 is armed as was previously described the setback acceleration continues, then its linear acceleration would assist the preloaded compressive spring 329 in accelerating the striker mass 305 towards the base of the inertial igniter to gain the required velocity (kinetic energy) to reliably initiate the pyrotechnic compound 313. It will be appreciated that the need for a preloaded compressive spring 329 arises only in cases in which either the (linear) setback acceleration magnitude is not high enough to accelerate the striker mass 305 to the required velocity (kinetic energy) or that its duration is not long enough so that following the inertial igniter arming (enabling), the setback linear acceleration could accelerate the striker mass the required velocity (kinetic energy).

The inertial igniter embodiment 300 of FIGS. 5, 6 and 7A and 330 of FIG. 8 are configured to be armed (enabled) with the applied setback acceleration induced counterclockwise spin acceleration. It is, however, appreciated by those skilled in the art that that such igniters can also be configured to be similarly armed if the direction of the setback induced spin acceleration is in the clockwise direction. This is done simply by changing the circumferential positioning of the spring 316 and its support element 315 and the stops 317 and 323 symmetrically about the guides 304.

In the above embodiments, following ignition of the pyrotechnics compound 313, FIG. 5, the generated flames and sparks are configured to exit downward through the opening 324 to initiate the thermal battery below. Alternatively, if the thermal battery is positioned above the inertial igniters, the opening 324 can be eliminated and the striker mass could be provided with at least one opening (not shown) to guide the ignition flame and sparks up through the striker mass 305 to allow the pyrotechnic materials (or the like) of a thermal battery (or the like) positioned above the inertial igniter (not shown) to be initiated.

Alternatively, side ports may be provided in the inertial igniter body 303 instead of the opening 324, FIG. 5, to allow the flame to exit from the side of the igniter to initiate the pyrotechnic materials (or the like) of a thermal battery or the like that is positioned around the body of the inertial igniter. Other alternatives known in the art may also be used.

The inertial igniter embodiments of FIGS. 5, 7A, 7B and 8 can be readily modified to operate as a so-called electrical "G-switch", i.e., to arm (enable) when a setback acceleration induced spin acceleration threshold is applied to the device, and then undergo the switching action either due to the enduring setback (linear) acceleration or by the action of a preloaded spring element such as the preloaded compressive spring 329 in the embodiment of FIG. 8. Here, the switching action refers to the closing (opening) a normally open (closed) electrical circuit. It is also appreciated by those skilled in the art that the resulting spin acceleration armed (enabled) and linear acceleration actuated electrical switches do not function as pure G-switches, but more accurately as "impulse switches" with spin acceleration arming capability. This is the case since these inertially activated switches operate when subjected to accelerations with certain prescribed magnitude as well as duration.

The construction and operation of the resulting electrical "G-switches" is identical to those of the inertial igniter embodiments of FIGS. 5, 7A, 7B and 8, except that the pyrotechnic compound 313 and the protruding tip 312 of the base 302 on one side and the sharp tip 311 of the striker mass 305 on the other side are replaced by contact and circuit closing (opening) elements described below.

Figure 9:
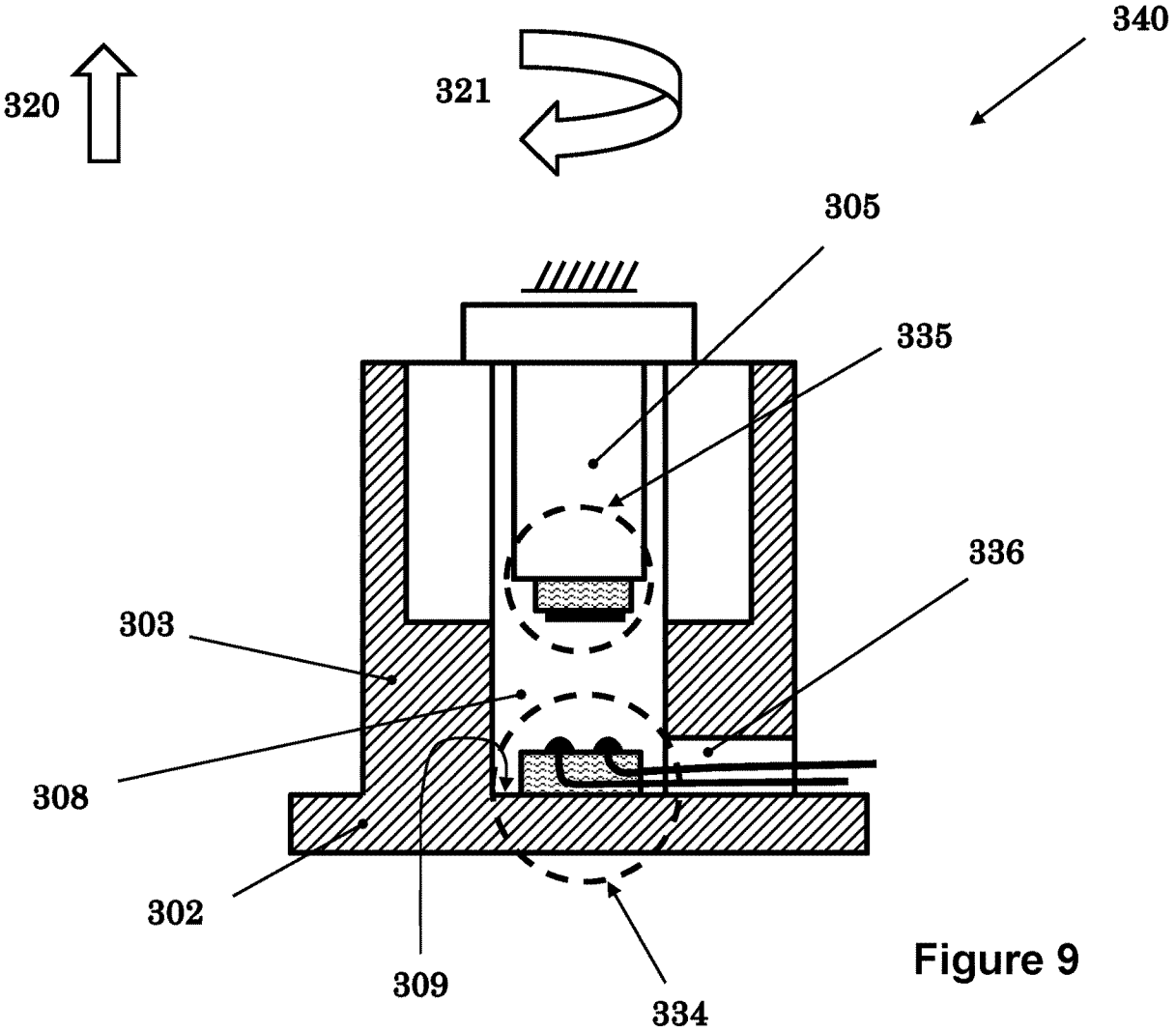
FIG. 9 illustrates a schematic of an electrical G-switch constructed based on the inertial igniter embodiment of FIG. 5 and configured to close an open circuit when it is similarly armed by a prescribed spin acceleration and actuated by a linear acceleration.

The schematic of one G-switch embodiment 340 constructed based on the design of the inertial igniter embodiment 300 of FIG. 5 is shown in FIG. 9. In this embodiment, the pyrotechnic compound 313, the protruding tip 312 of the base 302, the sharp tip 311, and the opening 324 are eliminated from the inertial igniter embodiment of FIG. 5. Instead, the device is provided with the contact element 334 on the surface 309 inside the device body 303 and by the contact bridging element 335 on the bottom surface of the formerly striker mass 305 as shown in FIG. 9. An opening 336 is also provided on the side of the device body 303 (or alternatively on the base 302) to pass the switching wires through. All other elements of the G-switch 340 are indicated with the same numerals as the inertial igniter 300 of FIG. 5.

Figure 10B:
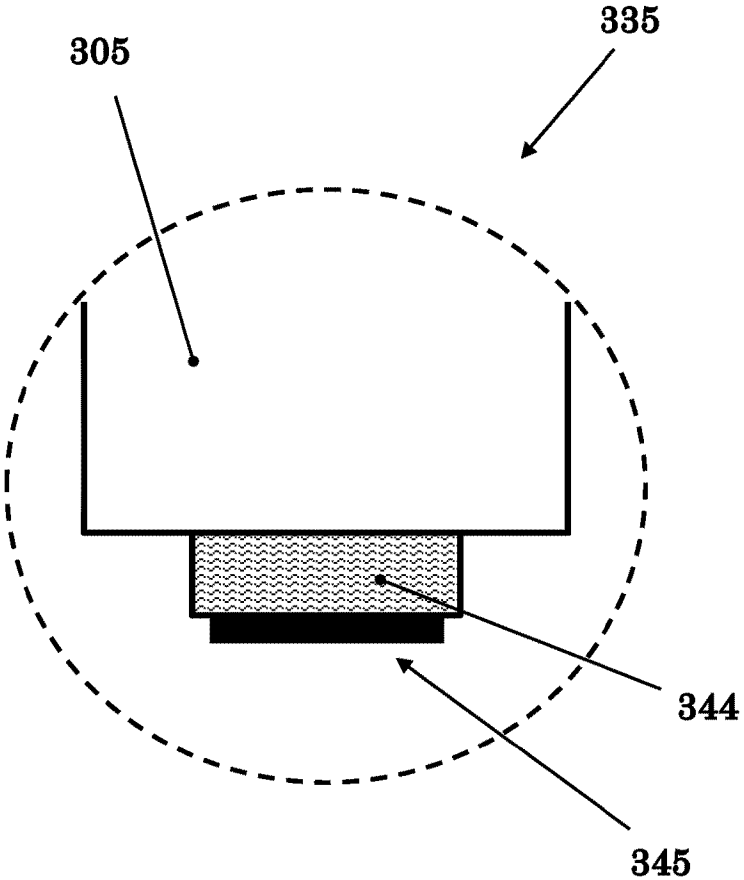
FIGS. 10A and 10B illustrates the schematic of the G-switch embodiment of FIG. 9.
Figure 10A:
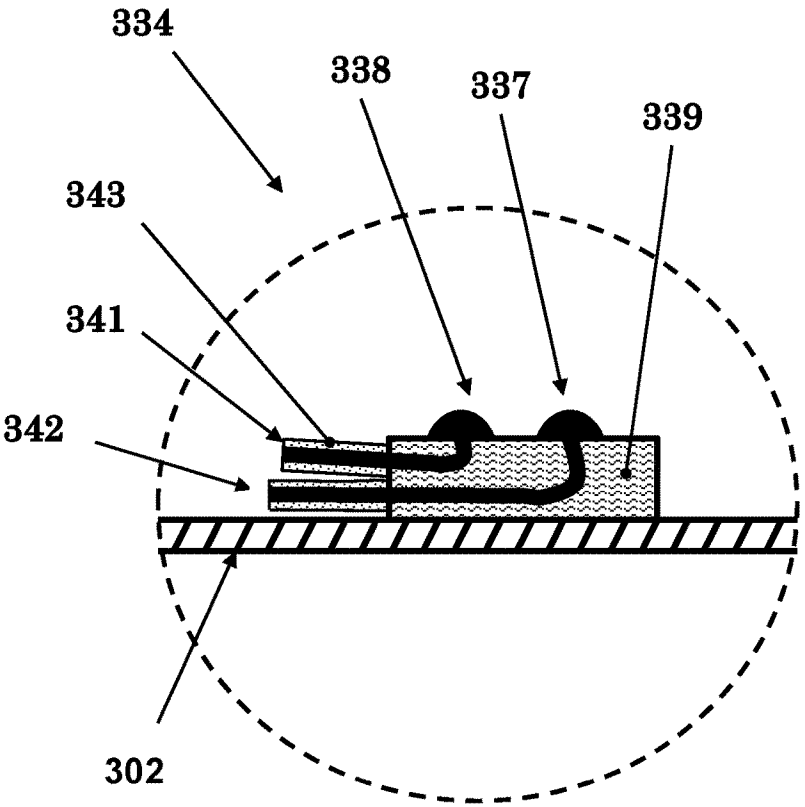

The close-up view of the contact element 334 is shown in the schematic of FIG. 10A. The contact element 334 is fixed to the surface 309 inside the device body 303 and is constructed with at least two contacts 337 and 338, which are mounted on an electrically non-conductive base 339. The contact element 334 is also provided with electrically conductive wires 341 and 342, which are connected to the contacts 338 and 337, respectively. The electrically conductive wires are passed through the electrically non-conductive base 339 as shown in FIG. 10A to prevent them from making contact. The wires passed through the electrically non-conductive base 339 are provided with electrically insulating casing 343 (not shown in FIG. 9).

In applications in which the G-switch 340 is attached, for example, to a printed circuit board, the electrically non-conducting base 339 can be mounted over a provided opening (similar to the opening 324, FIG. 5) in the base 302 of the device body, such as in a provided recess (not shown), thereby allowing the contact wires 341 and 342 to pass through the provided opening to reach the underlying element (in this case the printed circuit board or the like). The wires can then be connected to the appropriately provided circuit.

The close-up view of the contact element 335 is shown in the schematic of FIG. 10B. The contact element 335 consists of an electrically non-conductive base 344, which is fixed to the bottom surface of the member 305 (striker mass in the inertial igniter embodiments of FIGS. 5, 7A, 7B and 8) as shown in FIGS. 9 and 10B. An electrically conductive contact strip 345 (which can be relatively thin and flexible) is mounted on the surface of the electrically non-conductive base 344.

The electrical G-switch 340 operates in a manner like the inertial igniter 300 of FIGS. 5 and 6. That is in case of any non-trivial linear acceleration in the axial direction indicated by the arrow 320 in FIG. 5 (which corresponds to the direction of munitions firing, i.e., the direction of firing setback acceleration), the stop 319 prevents upward motion and the upper surface 314 of the inertial igniter body, being in contact with the ends 307 of the top portion 306, prevent downward motion of the striker mass 305 relative to the inertial igniter body (G-switch device body) 303. It is noted that the arrow 320 is intended to indicate the direction of the firing setback acceleration to munitions to which the base 302 and/or the body 303 of the inertial igniter 300 (G-switch body for the embodiment of FIG. 9) is fixedly attached.

In addition, if the G-switch embodiment 340 (inertial igniter in FIG. 5) is subjected to a spin acceleration in the clockwise direction about its long axis (perpendicular to the plane of the FIG. 6 and as indicated by the arrow 321 in FIG. 5 and arrow 322 in FIG. 6), then the stop 317 would prevent the striker mass 305 from rotation about the axis relative to the G-switch (inertial igniter in FIGS. 5 and 6) body 303.

However, if the G-switch is subjected to a spin acceleration in the counterclockwise direction about its long axis, assuming no friction between the surfaces of the striker mass 305 and the inertial igniter body 303, in the absence of the spring 316 (FIG. 6), the device body 303 would begin to rotate in the counterclockwise direction while the striker mass 305 would stay stationary. However, in the presence of the preloaded tensile spring 316, as the G-switch body 303 begins to rotate in the counterclockwise direction, the preloaded tensile spring 316 tends to extend and reduce its tensile preloading force if the (inertial) resistance of the striker mass 305 to the applied counterclockwise acceleration is larger than resisting torque applied to the striker mass by the preloaded tensile spring 316. Noting that the inertial resistance of the striker mass is due to its moment of inertial about its long axis (axis of its rotation relative to the inertial ignite body 303). Otherwise the end 307 of the top portion 306 striker mass 305 is forced by the preloaded tensile spring to stay in contact with the stop 317, FIG. 6, and the striker mass 305 does not undergo any rotation relative to the inertial igniter body 303 and is accelerated together with the inertial igniter body 303.

However, if the spin acceleration applied to the inertial igniter body in the counterclockwise is high enough for the resulting resisting inertial torque of the striker mass 305 to overcome the tensile preloading force of the spring 316, then the tensile spring 316 will begin to extend, thereby allowing the striker mass 305 to rotate in the clockwise direction relative to the G-switch (inertial igniter) body 303. If the spin acceleration magnitude is at or above the prescribed threshold and continues for its prescribed duration threshold, then the tensile spring 316 would be extended long enough to allow counterclockwise rotation of the striker mass 305 relative to the G-switch (inertial igniter) body 303 to position the tips 307 of the striker mass 305 over the guides 304 of the inertial igniter body 303. As can be seen in the top view of FIG. 6, a stop 323 which is fixedly attached to the top surface 314 of the G-switch (inertial igniter) body 303 would prevent rotation of the tips 307 passed the guides 304.

It will be appreciated by those skilled in the art that once the tips 307 of the striker mass 305 are positioned over the guides 304 of the G-switch (inertial igniter) body 303, then the striker mass 305 is free to move down the cylindrical open compartment 308 of the G-switch body 303 towards the base 302. The G-switch 340 is therefore considered to be armed (enabled) to respond to the linear setback acceleration.

Once the G-switch 340 is armed (enabled) by the applied spin acceleration of magnitude and duration corresponding to the prescribed all-fire setback induced spin acceleration profile threshold, the setback linear acceleration would accelerate the striker mass 305 downward and cause the electrically conductive contact strip 345 of contact element 335 to come into contact with the at least two contacts 337 and 338 of the contact element 334, FIGS. 10A and 10B, thereby closing the open circuit to which the G-switch 340 is connected.

It will be appreciated by those skilled in the art that in the G-switch embodiment 340 of FIG. 9, once the aforementioned setback acceleration event that induced G-switch arming and electrical switching action to close the normally open circuit has ceased, the contact between the electrically conductive contact strip 345 of contact element 335 and the at least two contacts 337 and 338 of the contact element 334, FIGS. 10A and 10B, may be lost. Such G-switches are appropriate for circuits that only require a single and short duration circuit closing event (pulse) for their proper operation. However, if the contact is to be maintained, particularly when a contact maintaining force is also desired to be present, then the G-switch may be configured as was described for the inertial igniter 330 of FIG. 8, in which a preloaded compressive spring 329 is used to keep pressing the striker mass 305 against the protruding tip 312 of the base 302 following its arming and downward travel of the striker mass.

Figure 11:
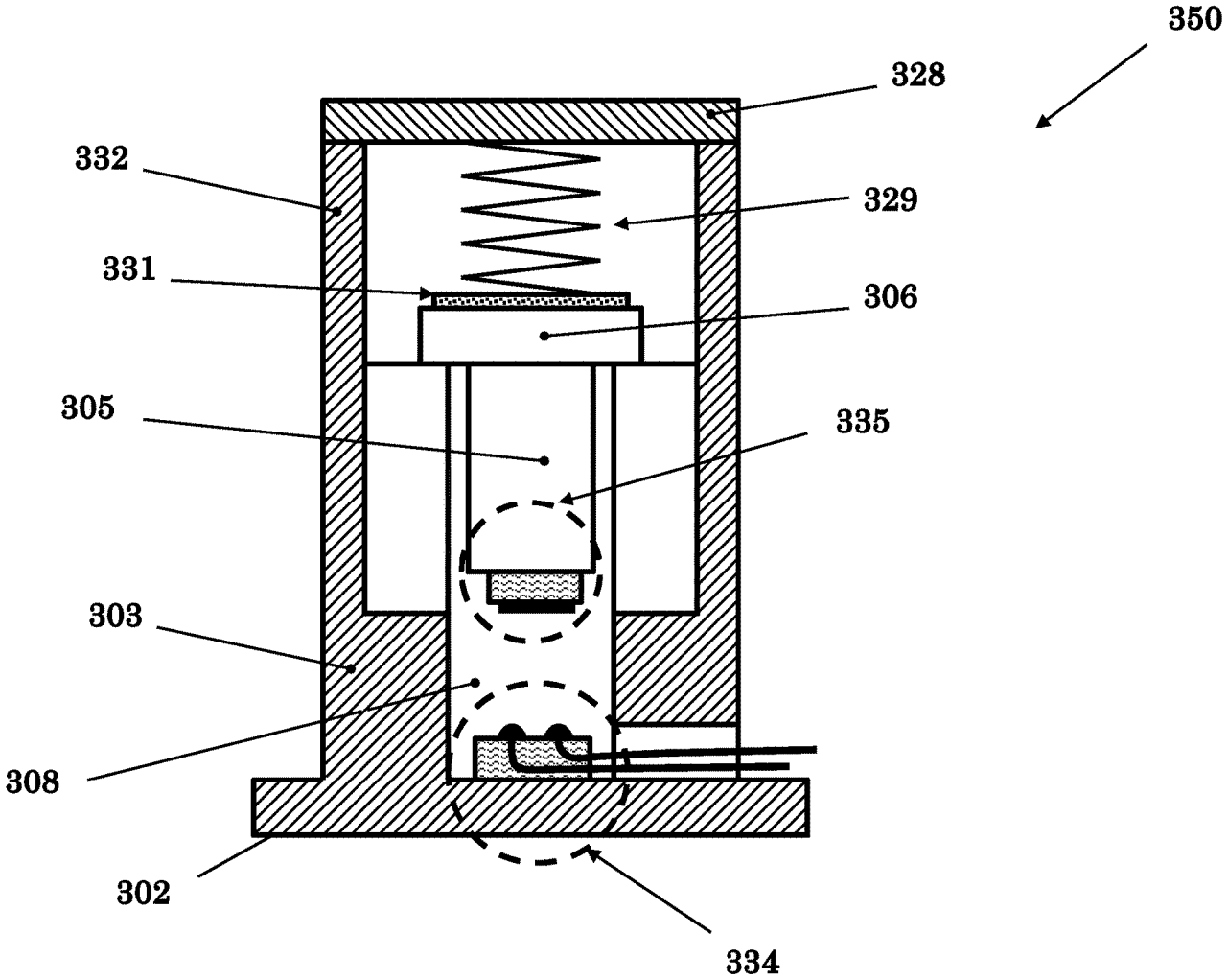
FIG. 11 illustrates a schematic of an alternative embodiment of the electrical G-switch of the embodiment of FIG. 9 for the construction of a latching normally open electrical G-switch.

The schematic of the resulting latching normally open G-switch (in its open state), indicated as the embodiment 350, is shown in FIG. 11. All components of the G-switch embodiment 350 are the same as those of the embodiment 330 of FIG. 8, except for the aforementioned changes to the embodiment for the embodiment 300 to obtain the G-switch embodiment 340 of FIG. 9, i.e., the provision of the contact element 334 on the surface 309 inside the device body 303 and by the contact bridging element 335 on the striker mass 305. An opening 336, FIG. 9, is similarly provided on the side of the device body 303 (or alternatively on the base 302) to pass the switching wires through. The G-switch embodiment 350 operates as described for the G-switch embodiment 340 of FIG. 9, except that once the device body 303 is released following the device arming and circuit closing action of the G-switch as was previously described, the compressively preloaded spring 329 acts as a latching mechanism and ensure that contact between the electrically conductive contact strip 345 of contact element 335 and the at least two contacts 337 and 338 of the contact element 334, FIGS. 9, 10A and 10B, is maintained and that the compressively preloaded spring 329 keeps the contact under a prescribed level of pressure.

It will be appreciated by those skilled in the art that the level of preloading of the compressive spring 329 must be high enough so that during the firing set-forward and when the munitions or the like is subjected to incidental acceleration and deceleration levels such as due to transportation vibration, contact between the electrically conductive contact strip 345 of contact element 335 and the at least two contacts 337 and 338 of the contact element 334, FIGS. 9, 10A and 10B, is maintained and that the compressively preloaded spring 329 keeps the contact under a prescribed minimum level of pressure.

It is also appreciated by those skilled in the art that the aforementioned spin acceleration threshold required to arm (enable) the G-switch 340 and 350 of FIGS. 9 and 11, respectively, and the parameters and preloading level of the tension spring 316, FIG. 6, must be selected such that considering the munitions firing spin acceleration magnitude and duration profile has enough duration to rotate the striker mass 305 clockwise relative to the inertial igniter body to its said arming (enabling) position, and allow the striker mass 305 to be accelerated downward to achieve the described contact between the electrically conductive contact strip 345 of contact element 335 and the at least two contacts 337 and 338 of the contact element 334, FIGS. 9, 10A and 10B, for the case of the G-switch embodiment 340 of FIG. 9.

For the case of the G-switch embodiment 350 of FIG. 11, the compressively preloaded spring 329 drives the striker mass downward with or without the continuing setback linear acceleration and also acts as a latching mechanism and ensure that contact between the electrically conductive contact strip 345 of contact element 335 and the at least two contacts 337 and 338 of the contact element 334, FIGS. 9, 10A and 10B, is maintained and that the compressively preloaded spring 329 keeps the contact under a prescribed level of pressure.

The For the case of the G-switch embodiment 340 of FIG. 9 may also be configured as a non-latching normally open G-switch by providing return springs 326 and/or 327 as is shown for the inertial igniter embodiment of FIG. 7A. By providing the return springs 326 and/or 327, the chances of getting multiple circuit open and closing actions is also eliminated.

It will also be appreciated by those skilled in the art that numerous other return spring designs and configurations are also possible and those illustrated in the schematic of FIG. 7A should be considered only as two of such design examples.

It will also be appreciated by those skilled in the art that as can be seen in the schematic of FIG. 6, once the striker mass 305 is armed and begins to move down towards the base 302, the U-shaped holding member 318 inside which one end 307 of the top portion 306 of the striker mass 305 is held is released. Thus, in the case of the alternative embodiment of the G-switch embodiment 340 of FIG. 9 with the springs 325 and/or 327, FIG. 7A, following arming of the striker mass 305, the provided springs 325 and/or 327 push the striker mass up away from the G-switch base 302. In this configuration, however, the end 307 of the top portion 306 of the striker mass 305 cannot re-engage the U-shaped holding member 318 to be pulled back by a preloaded tensile spring 316 to it prior-arming (disarmed) position shown in FIG. 6. The alternative G-switch embodiment 340 with the springs 325 and/or 327, FIG. 7A, may be readily modified to allow the striker mass 305 to be returned to its prior-arming (disarmed) position shown in FIG. 6 by extending the portion of the end 307 that engages the U-shaped holding member 318 as shown in the schematic of FIG. 7B. The extension, indicated by the numeral 333 in FIG. 7B, will then stays engaged with the U-shaped holding member 318, i.e., before and after the G-switch arming as the striker mass 305 moves down towards the G-switch base 302. Then as the striker mass 305 is pushed up by the springs 325 and/or 327, the extension 333 rides back in the U-shaped holding member 318 until the preloaded tensile spring 316 can rotate the striker mass to it prior-arming (disarmed) position shown in FIG. 6.

The G-switch embodiments 340 and 350 of FIGS. 9 and 11, respectively, the G-switches are configured to be armed (enabled) with the applied setback acceleration induced counterclockwise spin acceleration. It is, however, appreciated by those skilled in the art that the G-switches can also be configured to be similarly armed if the direction of the setback induced spin acceleration is in the clockwise direction. This is done simply by changing the circumferential positioning of the spring 316 and its support element 315 and the stops 317 and 323 symmetrically about the guides 304.

It will be appreciated by those skilled in the art that in the above inertial igniter and G-switch embodiments of the present invention the spin acceleration is considered to be applied about or close to the axis of symmetry of the device (effectively the longitudinal axis of rotation of the striker mass 305 relative to the device body 303). This would obviously occur only when the device axis of symmetry is coincident or close to the spin axis of the munitions. Otherwise the inertial igniter and G-switch will also be subjected to centrifugal force due to centripetal acceleration. The main effect of centrifugal force on the inertial igniter and G-switch embodiments of the present invention would be to press the surface of the striker mass 305 against the surface 310 of the cylindrical open compartment 308, FIG. 5, thereby increasing resistance to translation and rotation of the striker mass 305 relative to the device body 303 due to the resulting friction forces between the two contacting surfaces. In such cases, the device designer must consider the effect of the generated resisting torque to the rotation of the striker mass relative to the device body 303 in determining the required spin acceleration magnitude threshold for arming the device and the generated resisting friction force to linear translation of the striker mass 305 downward towards the device base 302 following device arming.

In general, there are three basic methods that can be used to reduce the level of generated resisting torque. Firstly, the contacting surfaces may be coated or provided by a layer of low friction material such as Teflon or other such materials or lubricants such as graphite. This method can also be used to reduce friction between the top surface 314 of the device body 303, FIG. 5, and the top portion 306 of the striker mass 305. The second method is to reduce the diameter of the rotating portion of the striker mass 305 so that the moment arm of the generated friction forces becomes small and therefore the resistance torque level is also reduced. The third method consists of providing rolling elements around the rotating portion of the striker mass, for example by providing at least two rows of (at least three) balls in provided dimples in the device body 303 at the surface of the cylindrical open compartment 308, as shown in the schematic of FIG. 12, against which the rotating portion of the striker mass 305 would rotate and translate relative the device body.

Figure 12:
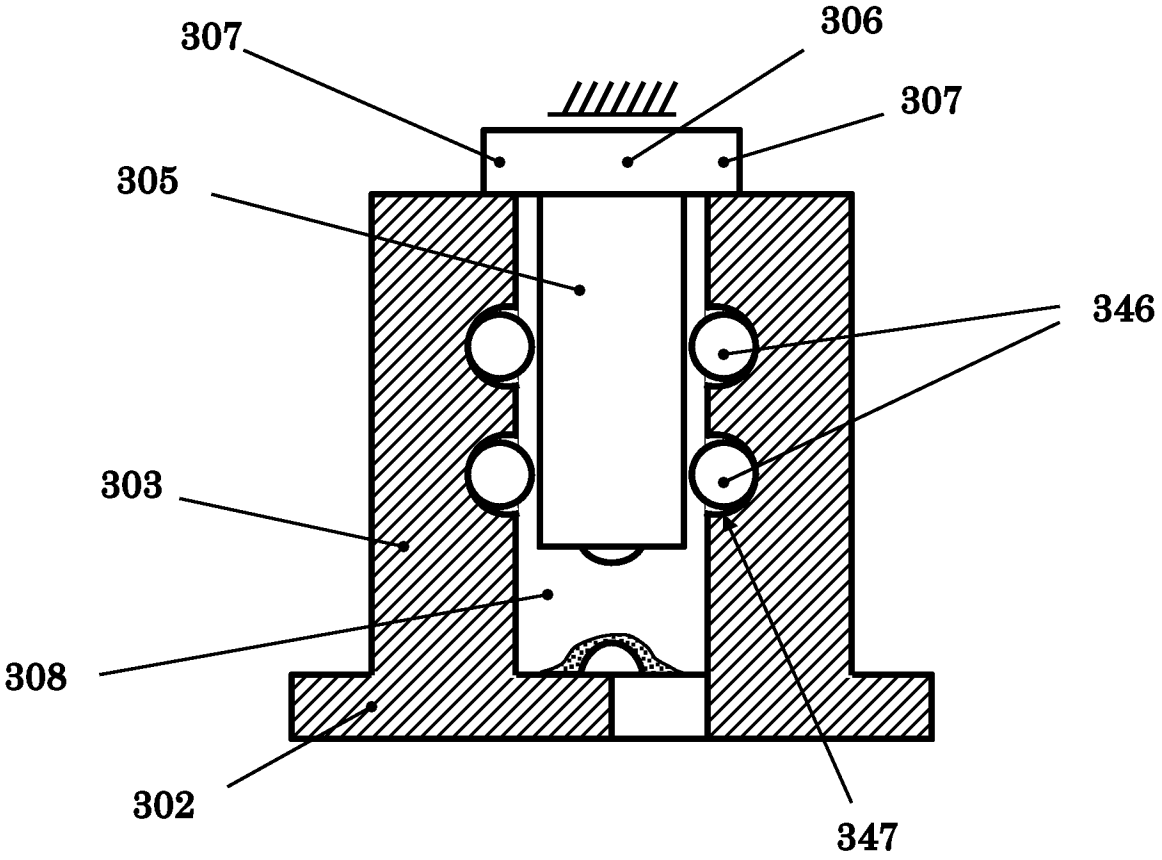
FIG. 12 illustrates a schematic of the inertial igniter and G-switch embodiments provided with rows of balls provided to reduce linear as well as rotary friction between the device body and the striker mass.

In the modifications to the above inertial igniter and electrical G-switch embodiments shown in the cross-sectional view of FIG. 12 (the cross-sectional view through the section of the device body that does not include the guides 304), rows of balls 346 are provided which are positioned in dimples 347 in the device body 303 as shown in FIG. 12. Then the striker mass 305 would rotate and translate relative to the device body 303 while mostly in contact with the rolling balls 346 with significantly reduced friction and if properly designed and lubricated with negligible friction.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. An apparatus actuatable under a rotary acceleration having a predetermined duration and magnitude, the apparatus comprising:

a body having a first channel and a second channel, the second channel being disposed radially offset from the first channel;

a mass disposed in the first channel, the mass having an arm disposed at a first end of the mass and the arm being rotatable from a first position in which the arm cannot move within the second channel to a second position in which the arm can move inside the second channel; and a first biasing spring member having a first end connected to the body and a second end connected to the arm such that when the arm is subjected to the rotary acceleration greater than the predetermined duration and magnitude, the arm is biased to rotate from the first position to the second position;

wherein the mass is connected to the arm such that the mass moves in the first channel and the arm moves in the second channel when the arm is biased into the second position; and the arm further having an extension extending in a direction of the second channel such that the extension extends outside the body when the arm moves in the second channel.

2. The apparatus of claim 1, further comprising:

a first projection disposed at a second end of the mass;

a second projection disposed at a bottom of the first channel;

a flame means disposed on one or more of the first and second projections for producing a flame when the first projection impacts the second projection; and one or more through holes disposed in the body;

wherein the first projection impacts the second projection to produce the flame, which travels through the one or more through holes, when the mass moves in the first channel and the arm moves in the second channel.

3. The apparatus of claim 1, further comprising:

an insulated first contact disposed at a second end of the mass;

an insulated pair of second contacts disposed at a bottom of the first channel in a direction away from the arm, the pair of second contacts forming an open circuit; and wherein the first contact contacts the pair of second contacts to close the open circuit when the mass moves in the first channel and the arm moves in the second channel.

4. The apparatus of claim 1, wherein the arm comprises two arms and the second channel comprises two channels, each of the two arms moves in a respective one of the two channels.

5. The apparatus of claim 1, further comprising one or more stops positioned on the body for limiting a rotation of the arm relative to the body.

6. The apparatus of claim 1, further comprising a second biasing spring member disposed in the first channel for biasing the mass away from a bottom of the first channel.

7. The apparatus of claim 1, further comprising a second biasing spring member disposed in the second channel for biasing the arm away from a bottom of the second channel.

8. The apparatus of claim 1, further comprising a second biasing spring member for biasing the mass towards a bottom of the second channel when the arm is rotated to the second position.

9. The apparatus of claim 1, further comprising ball bearings disposed between an inner periphery of the first channel and an outer periphery of the mass.

* * * * *